US010513781B2

(12) United States Patent
Schoenberg

(10) Patent No.: US 10,513,781 B2
(45) Date of Patent: Dec. 24, 2019

(54) TREATMENT DEVICE FOR PICKLING AND PHOSPHATING METAL PARTS, AND TREATMENT METHOD, AND TREATMENT PLANT FOR GALVANIZING THE METAL PARTS

(71) Applicant: RETOMAX AG, Vaduz (LI)

(72) Inventor: Joachim Schoenberg, Ummendorf (DE)

(73) Assignee: RETOMAX AG, Vaduz (LI)

( * ) Notice: Subject to any disclaimer, the term of this patent is extended or adjusted under 35 U.S.C. 154(b) by 0 days.

(21) Appl. No.: 15/774,096

(22) PCT Filed: Nov. 7, 2016

(86) PCT No.: PCT/EP2016/076871
§ 371 (c)(1),
(2) Date: May 7, 2018

(87) PCT Pub. No.: WO2017/077123
PCT Pub. Date: May 11, 2017

(65) Prior Publication Data

US 2018/0312977 A1 Nov. 1, 2018

(30) Foreign Application Priority Data

Nov. 5, 2015 (DE) ..... 10 2015 014 322

(51) Int. Cl.
*C23C 22/07* (2006.01)
*C23G 3/00* (2006.01)
(Continued)

(52) U.S. Cl.
CPC ..... *C23C 22/07* (2013.01); *C23C 22/00* (2013.01); *C23C 22/08* (2013.01); *C23G 1/00* (2013.01); *C23G 1/06* (2013.01); *C23G 3/00* (2013.01)

(58) Field of Classification Search
CPC ..... C23C 22/07; C23C 22/00; C23C 22/08; C23G 1/00; C23G 1/06; C23G 3/00
See application file for complete search history.

(56) References Cited

U.S. PATENT DOCUMENTS 2,307,928 A * 1/1943 Hogaboom ..... C25F 1/00 204/206
2,322,134 A * 6/1943 Hodge ..... C01G 49/14 23/305 A (Continued)

FOREIGN PATENT DOCUMENTS

DE 103 45 801 A1 4/2005
WO 2015/070976 A1 5/2015
WO 2015/165600 A1 11/2015

OTHER PUBLICATIONS

PCT International Search Report and Written Opinion Application No. PCT/EP2016/076871 dated Feb. 17, 2017, Letter identifiers that indicate relevance of the cited documents (English Translation of Search Report).

(Continued)

*Primary Examiner* — Benjamin L Osterhout
(74) *Attorney, Agent, or Firm* — Brooks Kushman P.C.

(57) ABSTRACT

A treatment device is provided for single-stage treatment of a metal object, wherein the treatment comprises at least pickling and phosphating of the object. The treatment device comprises a treatment container for holding the object to be treated and for holding a flowable treatment substance, and a pumping apparatus for circulating at least a portion of the treatment substance. The treatment substance is flowable around at least part of the object to be treated, and the treatment substance is a phosphorus- or phosphate-containing solution. The phosphorus- or phosphate-containing solution consists of water and a reaction substance, and the reaction substance consists of phosphorus or of a phosphate (Continued)

and at least one additional substance that improves the treatment effect. The fraction of the phosphorous or the phosphate in the reaction substance is between 75 vol % to 94 vol %, and the reaction substance has no fractions of hydrochloric acid and sulfuric acid.

13 Claims, 18 Drawing Sheets

(51) Int. Cl.

| | |
|---|---|
| ***C23C 22/00*** | (2006.01) |
| ***C23C 22/08*** | (2006.01) |
| ***C23G 1/00*** | (2006.01) |
| ***C23G 1/06*** | (2006.01) |

(56) References Cited

U.S. PATENT DOCUMENTS 2,769,735 A * 11/1956 Miller ..... C23G 1/36 134/13
2,890,944 A * 6/1959 Hays ..... C23F 1/28 148/253
3,144,361 A * 8/1964 Klinghoffer ..... C23C 22/00 118/405
3,404,079 A * 10/1968 Boardman ..... B05C 3/10 204/479
3,562,016 A * 2/1971 Lancy ..... C23F 1/00 134/13
3,575,711 A * 4/1971 Krofchak ..... C01G 49/14 134/13
4,197,139 A * 4/1980 Hjersted ..... C23G 1/36 134/12
5,308,413 A * 5/1994 Sobata ..... C23C 22/73 148/255
5,336,336 A * 8/1994 Matsuda ..... C23C 22/00 148/240
5,510,018 A * 4/1996 Rey ..... C23C 2/00 118/419
5,931,174 A * 8/1999 Salas ..... B01D 17/0202 134/85
6,235,111 B1 * 5/2001 Comiso ..... C23C 22/00 118/226
2002/0001967 A1 * 1/2002 Yokomizo ..... H01L 21/31111 438/745
2003/0136763 A1 * 7/2003 Nakagawa ..... C09G 1/02 216/83
2017/0051414 A1 2/2017 Schoenberg

OTHER PUBLICATIONS

PCT International Preliminary Report on Patentability Application No. PCT/EP2016/076871 dated Feb. 16, 2018, English Translation.
D5—DE 103 45 801 A1, Abstract & Machine Translation.
D6—WO 2015/070976 A1, Abstract & Machine Translation.
D1—WO 2015/165600 A1, US 2017/0051414 A1.
D2—"Betona Kristallbeizverfahren", "Betona crystal pickling method" (English Translation).
D3—"Mit einem Tauchbad beizen und phosphatieren", "Pickling and phosphating using a dipping bath" (English Translation).
D4—"Vecom Ist Auf Strengere Umweltnormen Vorbereitet" Technical Bulletin, "Vecom is Prepared for Stricter Environmentsl Standards" Technical Bulletin (English Translation).
D7—"Pre-Commission Cleaning" Technical Bulletin, "Pre-Commission Cleaning" Technical Bulletin (English Translation).
D8—"Sieben Arbeitsschritte in einem Prozess", "Seven work steps in one process" (English Translation).
D2—"Betona Kristallbeizverfahren", 2012, XP055342685, [Retrieved on Feb. 6, 2017] Internet: URL:http://betona-kristallbeize.de/betona,html pp. 1-3.
D3—Horschig J., "Mit einem Tauchbad beizen and phosphatleren", besser lackieren., Mar. 13, 2013, XP055340858, Vincentz Network [ Retrieved on Jan. 31, 2017] URL:http://www.besserlackieren.de/layout/set/print/industrielle-Anwendungen/Sonstige-Beschichtungen/Mit-einem-Tauchbad-beizen-und-phosphatieren, 1 Page.
D4—Keijzer M., "Vecom Inst Auf Strengere Umweltnormen Vorbereitet", Technical Bulletin, vol. PRD 2004/07, Apr. 2004, XP055342279, 1 Page.
D7—Van Os T: "Pre-Commission Cleaning", Technical Bulletin, vol. 2004/19, Oct. 2004, XP055342285, pp. 1-3.
D8—Schoenberg J: "Sieben Arbeitsschritte in einem Prozess", JOT—Journal Fur Oberflachentechnik, vol. 50, No. 11, Nov. 2010, XP055340860 pp. 60-61.
PCT International Search Report and Written Opinion dated Feb. 17, 2017, Application No. PCT/EP2016/076871, Applicant RETOMAX AG, 19 Pages.
PCT International Preliminary Report on Patentability dated Feb. 16, 2018, Application No. PCT/EP2016/076871 Applicant RETOMAX AG, 15 Pages.

* cited by examiner

TREATMENT DEVICE FOR PICKLING AND PHOSPHATING METAL PARTS, AND TREATMENT METHOD, AND TREATMENT PLANT FOR GALVANIZING THE METAL PARTS

CROSS-REFERENCE TO RELATED APPLICATIONS

This application is the U.S. national phase of PCT Application No. PCT/EP2016/076871 filed on Nov. 7, 2016, which claims priority to German Patent Application No. DE 10 2015 014 322.0 filed on Nov. 5, 2015, the disclosures of which are incorporated in their entirety by reference herein.

TECHNICAL FIELD

The present disclosure relates to a treatment device for treating objects, a treatment method for at least pickling and phosphating a metallic treatment object and for galvanizing the metallic object, and a metallic object.

BACKGROUND

Previous treatment facilities for phosphating objects require a plurality of work steps, in particular seven work steps, and for this purpose have a plurality of different baths. The object is initially placed in a first bath in which a first liquid for degreasing the object is provided. After the degreasing, the object must be removed from the first bath and conveyed into a second bath. A rinse liquid for rinsing the object is provided in the second bath. After the rinsing, the object is conveyed into a third bath. The third bath is filled with a hydrochloric acid/sulfuric acid mixture. After the hydrochloric acid/sulfuric acid treatment, the object is successively conveyed into two further baths, each filled with a rinse liquid, for rinsing the object. In addition, after the last rinse bath the object is conveyed into a bath for passivation. After the passivation, the object is phosphated and then conveyed to another location for drying. In such a facility, the highly toxic and environmentally harmful chemicals in the degreasing baths and in the treatment baths must be completely replaced after approximately 6 to 8 weeks production time, since after this time the chemicals are depleted, and the sludge that forms must be removed from the baths. This means facility downtime and high replacement and disposal costs.

It is apparent that the facilities known from the prior art on the one hand require a very large amount of space since they must provide six different baths, and on the other hand require a very large number of different chemical substances in large quantities. In addition, conveying the objects from one bath to the next requires a great deal of time, and appropriate transport units and operating personnel. Furthermore, the chemicals used are toxic or environmentally harmful due to the fact that sulfuric acid and hydrochloric acid, for example, are used, as the result of which either costly safety measures must be carried out, or there is high risk to the personnel and the environment as well as the production bay structure, which is usually made of steel.

A further aim is to prevent hydrogen embrittlement of the treated workpieces or treatment objects. Hydrogen embrittlement usually takes place due to the penetration and intercalation of hydrogen in a metal lattice, and may result in material fatigue. Hydrogen embrittlement occurs when, either due to hydrogen corrosion or some other chemical reaction in the metal processing in which hydrogen is involved, atomic hydrogen, which is bound to the material more quickly than it combines to form nondiffusible $H_2$ molecules on the material surface, forms on the metal surface. A portion of the hydrogen is intercalated in the metal lattice, or is deposited at defects or at the grain boundary. Depending on the stress on the particular object, for example due to the introduction of tensile residual stresses and/or tensile load stresses, there is a risk of material failure.

SUMMARY

The object of the present invention, therefore, is to provide a treatment device and a treatment method, the aim being to avoid at least one disadvantage, preferably several disadvantages, and particularly preferably all of the above-mentioned disadvantages, of the treatment facilities for phosphating objects known from the prior art by use of the treatment device according to the invention and the treatment method according to the invention. The aim is particularly preferably to improve the surface quality of a treatment object that is treated according to the invention.

According to a first aspect of the invention, the above-mentioned object is achieved by a treatment device for the single-stage treatment of a metal treatment object, wherein the treatment comprises at least the pickling and the phosphating of the treatment object. The treatment device according to the invention, in particular a bath facility, preferably includes a treatment container for holding the treatment object and for holding a flowable treatment substance, and a pump device for replacing at least a portion of the treatment substance, wherein the treatment substance flows around at least a portion of the treatment object, in particular the entire treatment object, wherein the treatment substance is a phosphorus- or phosphate-containing solution, in particular phosphoric acid, wherein the phosphorus- or phosphate-containing solution consists of water on the one hand and a reaction substance on the other hand, wherein the reaction substance consists of phosphorus or a phosphate and preferably at least one additional substance that improves the treatment effect, in particular containing one or more inhibitors, and water, in particular deionized water, wherein the fraction of the phosphorus or the phosphate in the reaction substance is between 60 vol % and 85 vol %, preferably between 70 vol % and 80 vol %, particularly preferably between 73 vol % and 77 vol %, most preferably between 74 vol % and 76 vol %, for example 76 vol %. The substance that improves the treatment effect, in particular one or more inhibitors, is preferably present in a quantity of 0.1 vol % to 2.5 vol %, preferably between 0.2 vol % and 2 vol %, and particularly preferably between 0.5 vol % and 1.5 vol %, of the reaction substance.

The further portions short of 100 vol % are preferably formed by water, in particular deionized water. The reaction substance preferably contains no fractions of hydrochloric acid or sulfuric acid, and preferably also no fractions of fluorine, chlorine, bromine, iodine, lead, mercury, or selenium. In addition, the reaction substance is mixed with water in a specified ratio, wherein the specified ratio is between a lower limit and an upper limit, wherein the lower limit is defined by a mixture in a ratio of 1 kg reaction substance to 4 liters water, and the upper limit is defined by a mixture [in a ratio] of 1 kg reaction substance to 8 liters water, and in particular the mixture is present in a ratio of 1 kg reaction substance to 6 liters water.

The reaction substance is thus preferably mixed with water in a ratio of between 1 kg reaction substance to 4 liters water and 1 kg reaction substance to 8 liters water, in particular mixed with water in a ratio of between 1 kg reaction substance to 6 liters water and 1 kg reaction substance to 7.8 liters water, in particular mixed in a ratio of exactly or essentially 1 kg reaction substance to 6.5 liters water or in a ratio of exactly or essentially 1 kg reaction substance to 6.8 liters water or in a ratio of exactly or essentially 1 kg reaction substance to 7 liters water or in a ratio of exactly or essentially 1 kg reaction substance to 7.2 liters water or in a ratio of exactly or essentially 1 kg reaction substance to 7.5 liters water.

This approach is advantageous due to the fact that a further coating, in particular creation of an adhesion-promoting layer and/or galvanization, is producible on the treatment object, and/or advantageous cleaning of the treatment object takes place. The formation of dross or spelter, for example during galvanizing of the treatment object, is reduced or prevented due to the produced protective layer. The formation of spelter has significant effects on the costs for galvanizing, since the spelter deposits in the zinc bath and must be laboriously removed therefrom, resulting in long downtimes and thus high costs. Reducing or preventing the spelter formation thus has significant positive effects on the manufacturing speed and manufacturing costs for metallic objects that undergo galvanizing. In addition, the protective layer prevents, for example, the material of the treatment object from oxidizing, so that a treatment object that is treated by means of the device according to the invention may be exposed to air for a much longer period than an untreated object.

According to another preferred embodiment of the present invention, a turbulence device for turbulizing impurities, in particular solid particles, that deposit in the treatment substance is provided, wherein the turbulence device has at least one provision device and a fluid line element with a plurality of outlet openings for supplying a turbulizing fluid to the treatment substance, wherein the turbulizing fluid is suppliable by the provision device to the fluid line element at a pressure of greater than 2 bar, in particular greater than 3 bar or greater than 4 bar or greater than 5 bar or greater than 6 bar or greater than 7 bar or up to 10 bar or up to 15 bar or up to 20 bar.

This embodiment is advantageous due to the fact that no toxic or environmentally harmful chemicals are used. In addition, the treatment substance does not have to be replaced and disposed of every 6-8 weeks, since due to the treatment device according to the invention a system layout is created in which the chemical system used is continuously purified. Losses of the treatment substance resulting from evaporation and carryover may be replenished by adding water and the reaction substance, which allows the required number of changes of the treatment substance per year to be reducible to fewer than 4 changes, in particular 2 or fewer than 2 changes, or 1 or less than 1 change. The treatment substance is preferably replaced only when a predetermined concentration of dissolved iron is present in the treatment substance, a replacement preferably taking place only when the concentration of dissolved iron is greater than 2%. In addition, due to the approach according to the invention, contaminants or impurities, in particular sludge and/or metal or rust particles, are hindered from depositing, and/or accumulations resulting from deposits are removed. The accumulations may be separated by the turbulence device, so that the impurities may once again be held as suspended matter in the treatment substance. As suspended matter, the impurities may then be discharged from the holding chamber by supplying portions of the treatment substance to the filter device.

According to another preferred embodiment of the present invention, the fluid line element forms multiple line sections that are decoupleable from one another, at least functionally or fluidically, by means of valve devices, at least the majority of the line sections being situated in the area of the base of the treatment container. An area of the base is considered to be any portion of the treatment container that is situated or provided closer to the base than to the top side of the treatment container. However, it is also conceivable for the fluid line element to be designed as an integral part of the base or formed in the base, and thus to be provided, completely or in sections, below the surface of the base directed toward the holding chamber. The fluid line element is preferably designed, at least in sections, so that it is situated less than 50 cm, preferably less than 30 cm, and particularly preferably less than 10 cm, from the base of the holding chamber. For a fluid line element that is situated above the base, the outlet openings or individual outlet openings, or the majority of the outlet openings or a minority of the outlet openings, are preferably introducible at the bottom, i.e., oriented in the direction of the base, or at the side, i.e., oriented in the direction of a wall or side wall of the holding chamber, or at the top, i.e., oriented in the direction of the entry opening of the holding chamber, through which the treatment objects are introducible into the holding chamber. In addition, it is conceivable for the outlet openings of various tubes to be directed in various directions. Moreover, it is conceivable for first outlet openings that are oriented in a first direction to be provided, and second outlet openings that are oriented in a second direction to be provided, for each line section or tube or on individual line sections or tubes, wherein the first direction and the second direction preferably have an orientation that differs by at least 10°, preferably by at least 20°, and particularly preferably by at least 45° or at least 60° or at least 90° or at least 120° or at least 150° or up to 180°. In addition, it is conceivable for third outlet openings to be provided that are oriented at an angle with respect to the first outlet openings, the angle being different from the angle between the first outlet openings and the second outlet openings. This may analogously apply for fourth outlet openings and/or fifth outlet openings, etc. This embodiment is advantageous due to the fact that the introduction of the turbulizing fluid or the functional fluid or the fluid, in particular air, may take place in a directed manner in such a way that the turbulences produced by the turbulizing fluid effectively break up the deposits.

According to another preferred embodiment of the present invention, the line sections are formed by tubes, in particular made of copper, aluminum, iron, and/or stainless steel, in particular having a tube diameter between 2 mm and 12 mm, preferably having a tube diameter between 3 mm and 9 mm, and particularly preferably having a tube diameter between 4 mm and 6 mm, wherein the tubes are coupled to the base of the treatment container or situated thereon, wherein the tubes are connected to one another by means of at least one distributor unit, and wherein each valve device is designed as a shutoff valve, in particular a shutoff solenoid valve.

The outlet openings are preferably designed as holes, in particular boreholes, and preferably have a diameter between 0.5 mm and 8 mm, preferably a diameter between 1.5 mm and 6 mm, and particularly preferably a diameter between 2.5 mm and 4 mm, in particular exactly or essentially 3 mm.

According to another preferred embodiment of the present invention, the provision device is designed as a [device] for providing gas, in particular air, that is under at least 2 bar pressure. In the case that the gas is air, the air is preferably composed of ambient air from the surroundings of the device according to the invention. This embodiment is advantageous due to the fact that ambient air is available at no cost, and because of its low density it automatically moves through the treatment substance and automatically moves out of the treatment substance. The air, by passing through the treatment substance, brings about a localized displacement of the treatment substance, thereby moving it, as the result of which turbulences could result.

According to another preferred embodiment of the present invention, a filter device for filtering the treatment substance is provided, wherein impurities that have become concentrated in the treatment substance are removed by the filtering. In addition, a control device for operating the filter device and the turbulence device is preferably provided. The filter device and the turbulence device are particularly preferably operable, at least at times, in dependence on one another.

This embodiment is advantageous due to the fact that the impurities may be removed from the treatment substance very efficiently due to the interaction of the turbulence device with the filter device.

According to another preferred embodiment of the present invention, the operation of the turbulence device includes providing the fluid and controlling the valve device, at least at times, wherein the valve devices are controllable according to predetermined patterns, in particular at programmed time intervals. It is thus possible for individual, multiple, the majority of, or all valve devices of the line element or individual line sections to be switched in such a way that fluid is supplied to the treatment substance through all outlet openings, fluidically connected to the open valve devices, for a preferably predetermined time period. However, it is also conceivable for individual one or more valve devices to be switched in succession, in particular in a pulsed manner. However, the individual valve devices are particularly preferably controlled by means of a predetermined program and/or preferably settable interval switching and/or as a function of status data of the treatment substance detected by means of a sensor device. The turbulence device is hereby particularly preferably activated and/or deactivated based on the sensor data. The sensor data may contain, for example, data concerning the proportion of impurities in the base area of the device and/or in one or individual area(s) of the treatment container. Additionally or alternatively, it is conceivable for the turbulence device to be activatable and/or deactivatable manually and/or by remote control.

In addition, the reaction substance particularly preferably contains no fractions of hydrochloric acid or sulfuric acid. This is advantageous due to the fact that very simple treatment of treatment objects is possible via the present invention. It is essentially necessary only for the treatment objects to be immersed in the treatment substance, for the treatment substance to act, and for the treatment object to dry after removal from the bath. In particular, due to the ultrapure phosphorus or the ultrapure phosphate, a protective layer is formed on the treatment objects after drying, so that they are protected from further adverse effects over a fairly long period of time, in particular several weeks, without the passivation and subsequent phosphating that are necessary according to the prior art, and in particular the resulting protective layer being far superior to the phosphating according to the prior art. This approach is also advantageous due to the fact that the treatment substance is incombustible, no threshold limit values (TLVs) are exceeded by using the treatment substance, and no corrosive vapors are caused, so that no exhaust venting is necessary.

Another advantage of the present invention is that, due to the substance(s) that improve(s) the treatment effect, significant protection is provided for the material, and the weldability is not adversely affected.

Yet another advantage is the versatility of the present invention. For example, it may be used for pretreatment and aftertreatment in hardening facilities, or for removing the oxide layer on aluminum. In addition, efflorescence during the galvanic finishing of cast parts may be avoided. This results in considerable savings on scrapers for the removal of casting skin. Furthermore, for example hydraulic pipes and pipelines may be pickled directly at construction sites in a single work operation, without the need for rinsing and neutralization.

In addition to the pickling and phosphating of the treatment object, the degreasing and/or derusting and/or descaling and/or preserving and/or decalcifying of the treatment object is/are particularly preferably likewise brought about by the treatment device according to the invention.

The following, strictly by way of example, may preferably be treated as treatment objects: metal parts such as aluminum parts, iron parts, gray cast iron parts, wire, steel parts, copper parts, or parts made of alloys, polymeric parts such as plastic parts or rubber parts, etc., in particular vehicle frames, pipes, machine parts, turbocharger parts, housings, automobile parts, hydraulic parts, cast steel parts, and turbine parts.

Unless indicated otherwise for the object of the present invention, the stated percentages with regard to the invention are percentages by volume. It is further noted that the stated percentages and stated temperatures in ° C. with regard to the invention relate to ambient pressure or standard pressure unless indicated otherwise for the object of the invention, and in addition the stated temperatures in ° C. may also correspondingly apply for Kelvin. However, with regard to the overall disclosure of the invention, one skilled in the art does not require further explanation of the statements of the invention concerning physical units in the event that a physical parameter is to be modified, since it is apparent to one skilled in the art to appropriately adapt the resulting changes to the other physical variables, without departing from the scope of protection of the invention.

Advantageous embodiments of the invention result from the subclaims, wherein a temperature control device for controlling the temperature of the treatment substance that may be kept in the treatment container is provided, wherein the temperature of the treatment substance is adjustable in a defined manner by means of the temperature control device.

The preferred temperature of the treatment substance is preferably greater than 0° C., in particular greater than or equal to 5° C., greater than or equal to 10° C., greater than or equal to 15° C., greater than or equal to 17° C., greater than or equal to 20° C., greater than or equal to 25° C., greater than or equal to 30° C., greater than or equal to 35° C., greater than or equal to 37° C., greater than or equal to 40° C., preferably between 20° C. and 60° C., and particularly preferably between 30° and 50° C. The temperature control of the treatment substance preferably represents heating of the treatment substance, although it is also conceivable for the temperature control to represent cooling. In addition, it is conceivable for the treatment substance to be at times heatable and at times coolable by the temperature control device. The temperature control device is preferably designed as an electric heating device, an electric cooling device, and/or a heat exchanger system. The work sequence may be controlled as a function of the temperature of the treatment substance. Strictly by way of example, the acceleration factor may be 20:20C×6 for the degreasing of rust. This means that the treatment object may be made rust-free by means of a treatment that takes place at 20° C. and lasts for 2 hours, or by means of a treatment that takes place at 40° C. and lasts for 20 minutes.

A particularly preferred operating temperature range is 35° C. to 45° C.; this temperature range is advantageous due to the fact that exhaust venting is not necessary since no vapors that are corrosive or harmful to the health arise. However, it is conceivable for exhaust venting to be provided when, for example, the work area is extremely low, or when the work area is not to be ventilated.

The phosphorus- and phosphate-containing solution preferably consists of deionized water and the reaction substance, wherein the proportion of reaction substance to deionized water is between 1:4 and 1:7, the proportion of reaction substance to deionized water preferably being 1:6 when the reaction substance is present in a solid state, or the proportion of reaction substance to deionized water preferably being 1:5 when the reaction substance is present in a liquid state.

According to another advantageous embodiment of the invention, the reaction substance also contains no fractions of fluorine, chlorine, bromine, iodine, lead, mercury, or selenium, so that the device according to the invention operates without materials or substances that are harmful to health or to the environment.

The pump device is preferably designed as a recirculation pump, and preferably brings about recirculation of the treatment substance within the treatment container. However, it is alternatively or additionally conceivable for a pump device to be provided for generating a weir flow. One or more nozzles via which the treatment substance is output in particular into treatment containers, in particular for bath recirculation, are preferably coupled to the pump device.

The treatment container is preferably implementable in any desired size. On the inner side, i.e., on the side that is in contact with the treatment substance, the treatment container particularly preferably has a material or a material mixture that is not attacked by the treatment substance. Examples of preferred materials, among others, are: stainless steel, GVP, PVC. However, it is also conceivable for not only the surface of the treatment container that is in contact with the treatment substance to be made of such a material, but also for additional elements of the treatment container, in particular the entire treatment container, to likewise be made of such a material or material mixture.

According to one preferred embodiment of the present invention, a filter device for filtering the treatment substance is provided, wherein impurities that have become concentrated in the treatment substance are removed from the treatment substance by the filtering. This embodiment is advantageous due to the fact that the treatment substance may be continuously or occasionally cleaned or prepared in the treatment container.

According to another preferred embodiment of the present invention, the treatment container is coupled to at least two holding chambers, wherein a first holding chamber is a buffer holding chamber, preferably provided beneath the treatment container, for holding a certain quantity of the treatment substance, and wherein a second holding chamber is a temperature control chamber provided at the side of the treatment container, wherein the temperature control device is at least partially situated in the temperature control chamber. The first holding chamber or the buffer chamber may be used, for example, for holding a desired volume of the treatment substance. In addition, it is conceivable for the first holding chamber or the buffer chamber to be used for holding or for depositing sediments. The sediments may, for example, be portions or particles that become detached from the treatment objects during the treatment. The temperature control chamber is preferably situated at the side of the treatment container, since very good access to the temperature control device may thus be provided. However, it is alternatively also conceivable for the temperature control device to be provided or situated in the first holding chamber or in the buffer chamber, i.e., beneath the treatment container. This embodiment is advantageous due to the fact that the individual fractions of the treatment substance may pass into different functional areas or holding chambers and the main holding chamber without the possibility of damage to units, such as the temperature control device, provided or situated in one or more holding areas, due to a collision with the treatment object.

According to yet another preferred embodiment of the present invention, the treatment container is separated by a wall from a collection chamber for collecting treatment substance that flows over the wall, wherein the treatment substance collected in the collection chamber is conveyable via a conveyor line back into the treatment container by means of a conveying device, in particular by means of the pump device. This embodiment is advantageous due to the fact that the particles that accumulate on the surface of the treatment substance and that are detached from the treatment object, and/or foam that forms on the surface of the treatment substance, and/or other material concentrations is/are dischargeable from the treatment container and preferably suppliable to the filter device.

According to another preferred embodiment of the present invention, the pump device and the filter device form an integral part of the conveyor line, and the conveyed treatment substance is preferably conveyed through the filter device by or by means of the pump device. This embodiment is advantageous due to the fact that the conveying of the treatment substance through the filter device and at least partial recirculation of the treatment substance in the treatment container are brought about as a result of this arrangement.

According to another preferred embodiment of the present invention, the, or a, conveyor line is designed in such a way that a weir flow for discharging a portion of the treatment substance from the treatment container and into the collection chamber is producible, preferably via the treatment substance that is conveyed back into the treatment container. This embodiment is advantageous due to the fact that the conveying of the treatment substance through the filter device, at least partial recirculation of the treatment substance in the treatment container, and the production of a weir flow may be brought about preferably by means of a pump device.

According to another preferred embodiment of the present invention, a dosing device for adjusting the composition of the treatment substance is provided, wherein the treatment substance consists of a mixture of multiple components. The dosing device is preferably coupled to one or more sensor devices, either directly, or indirectly via a control device, wherein the sensor devices preferably allow monitoring or analysis of the composition of the treatment substance and/or monitoring of the volume or the remaining quantity or the filling level of treatment substance present in the treatment container.

The dosing device brings about in particular the compensation for losses by adding the appropriate quantity of lost treatment substance; in particular evaporation and/or immersion losses are compensated for. The addition of the components that form the treatment substance, in particular deionized water, the reaction substance, and the substance that improves the treatment effect, preferably takes place via the dosing device. The addition of the components that form the treatment substance preferably takes place in a fixed ratio, in particular in the ratio in which the individual components are also provided in the treatment container, or in some other fixed ratio. In addition, it is conceivable for the treatment substance that is to be added to already be added in the form of a finished mixture or finished solution.

The sensor device may preferably be designed as a device for carrying out a titration, i.e., for determining a concentration. However, it is also conceivable for the dosing and introduction of substances into the treatment substance to partially, occasionally, or always take place manually.

According to another preferred embodiment of the present invention, the proportion of reaction substance to deionized water is between 1:4 and 1:7, the proportion of reaction substance to deionized water preferably being 1:6 when the reaction substance in a solid state is mixed with the deionized water, or the proportion of reaction substance to deionized water preferably being 1:5 when the reaction substance in a liquid state is mixed with the deionized water.

The losses are preferably likewise replaced in a fixed ratio of multiple substances. The preferred substance(s) is/are thus flowable, in particular liquid, or solid reaction substance(s), that is/are preferably mixed with a dilution substance, for example water, in particular desalinated water, distilled water, or deionized water. In addition, preferred mixing ratios of the reaction substance to the dilution substance, in particular deionized water, are for example 1:2; 1:3, 1:4; 1:5; 1:5.5; 1:6; 1:6.5; 1:7.5; 1:8; 1:8.5; 1:9.

A mixture or solution of one or more additional substances, in particular one or more liquids, in particular deionized water, and/or one or more preferably soluble additives are/is preferably admixed with the treatment substance automatically or manually, as a function of values generated by the sensors. In addition, it is conceivable for an additional substance, in particular for pickling degreasing and/or for defoaming, to be added to the treatment substance. The additional substance is preferably admixed with approximately 0.5% to 10%, in particular 1% to 5%, of the volume of the treatment substance. The use of deionized water is preferred, since an essentially uniform surface quality on the treatment objects is thus obtained.

The use of a pickling degreaser is advantageous due to the fact that impurities such as light grease deposits, dirt particles, oil, carbon, and graphite may be removed in the same work operation by adding the pickling degreaser to the treatment substance.

The pH of the reaction substance is preferably essentially 1, the density of the reaction substance is preferably 1.8 at a temperature of 20° C., and the flash point of the reaction substance is preferably 280° C. or preferably higher than 280° C.

In the case of treatment objects that contain or are made of aluminum, the treatment substance preferably contains deionized water, and in addition to the deionized water preferably contains a reaction substance in a quantity of 1-10%, in particular 3-5%, of the quantity of the deionized water. At a bath temperature of 40° C. to 45° C., i.e., when the treatment substance is controlled to a temperature of 40° C. to 45° C., the exposure time, i.e., the time for which the treatment object is exposed to the treatment substance in the treatment container, is preferably 0.5 minute to 20 minutes, and particularly preferably 1 minute to 10 minutes. The reaction substance preferably consists of phosphoric acid and inhibitors.

According to another preferred embodiment of the present invention, the treatment substance contains an additional substance for pickling degreasing, or such an additional substance is added to a treatment substance, wherein the pickling degreaser additive preferably contains an aqueous solution of nonionogenic biodegradable surfactants and inhibitors, in particular 2-butyne-1,4-diol, and wherein the pickling degreaser additive is added in a volume of 0.5% to 7% of the volume of the phosphorus- or phosphate-containing solution or of the treatment substance.

According to another preferred embodiment of the present invention, the treatment substance contains an additional substance for defoaming, wherein the defoamer additive preferably contains triisobutyl phosphate, and wherein the defoamer additive is added to the treatment substance in a volume of 0.01% to 5%, in particular in a volume of 0.1% to 1%, of the volume of the phosphorus- or phosphate-containing solution or of the treatment substance, or in a volume of 0.01% to 5%, in particular in a volume of 0.1% to 1%, of the volume of the phosphorus- or phosphate-containing solution added to the pickling degreaser additive, or of the treatment substance.

According to another preferred embodiment of the present invention, a control device is provided, wherein the control device controls the temperature control device in such a way that the treatment substance is controlled to a target temperature or a target temperature profile, and/or wherein the control device controls the pump device in such a way that the treatment substance is conveyed with a target flow velocity or a target flow characteristic, and/or the control device controls the filter device in such a way that the filtered portion of the treatment substance has a target purity, and/or the control device controls the dosing device in such a way that a target composition of the treatment substance is settable.

In addition, according to another embodiment of one or more further embodiments, it is conceivable for the treatment device to have one or more oil separator system(s), ultrasonic system(s), high-pressure system(s), rotating and lifting device(s), and/or deionized water supply system(s).

According to another preferred embodiment of the present invention, a degreasing bath, in particular for degreasing the treatment objects having an unusually high grease content, is provided, in particular upstream from the treatment container. This embodiment is advantageous due to the fact that the treatment substance in the degreasing bath may preferably be heated to a temperature that is higher than the preferred operating temperature or treatment temperature of the treatment substance in the treatment container. The temperature in the degreasing bath is preferably greater than 50° C., in particular greater than 52° C., and particularly preferably greater than or equal to 60° C. This embodiment is advantageous due to the fact that only very oily or greasy treatment objects may be introduced into a degreasing bath that is controlled to a temperature suitable for degreasing. This has significant energy-related advantages, since the temperature control of the degreasing bath, which is preferably heated to greater than 50° C., preferably does not have to take place continuously, and may be carried out only occasionally. In addition, the formation of water vapor in the area of the treatment container of the treatment device according to the invention may be prevented when the temperature of the treatment substance is below a threshold temperature, in particular below 52° C., or the treatment substance is not heated above this threshold temperature.

The invention further relates to a treatment method for at least pickling and phosphating a treatment object that is in particular metallic. The method according to the invention preferably comprises the steps of providing a treatment container for holding at least one treatment object and for holding a flowable treatment substance, wherein no further treatment container for degreasing and phosphating is used; introducing the treatment substance into the treatment container and introducing the treatment object into the treatment container that is at least partially filled with the treatment substance in order to bring the treatment object into contact with the treatment substance, wherein at least pickling and phosphating of the treatment object is brought about due to the contact between the treatment substance and the treatment object, wherein the treatment substance is a phosphorus- or phosphate-containing solution, in particular phosphoric acid; removing the treatment object from the treatment container; turbulizing, by means of a turbulence device, impurities that are transferred to the treatment substance by the treatment object, wherein for turbulizing the impurities, a fluid is supplied to the treatment substance via the turbulence device; supplying the treatment substance, provided with the turbulized impurities, to a filter device; filtering out the impurities, supplied to the filter device, from the treatment substance fractions; reintroducing the treatment object into the treatment container, which is at least partially filled with the treatment substance, for bringing the treatment object into contact with the filtered treatment substance, or introducing a further treatment object into the treatment container, which is at least partially filled with the treatment substance, for bringing the treatment object into contact with the filtered treatment substance.

The phosphorus- or phosphate-containing solution preferably consists of deionized water on the one hand and a reaction substance on the other hand, wherein the reaction substance consists of phosphorus or a phosphate and an additional substance that improves the treatment effect, wherein the fraction of the phosphorus or of the phosphate in the reaction substance is at least 75%, wherein the reaction substance in particular contains no fractions of hydrochloric acid or sulfuric acid.

The treatment method according to the invention is advantageous due to the fact that a closed circuit is created which makes a rinsing operation, and thus conveying of the object into a rinse tank, unnecessary. In addition, the method according to the invention is extremely advantageous due to the fact that it allows very thorough, protective, and rapid treatment of the treatment object, in particular compared to mechanical treatment methods. This approach is also advantageous due to the fact that the treatment substance is incombustible, no threshold limit values (TLVs) are exceeded by using the treatment substance, and no corrosive vapors are caused, so that no exhaust venting is necessary.

According to another preferred embodiment of the present invention, a control device for operating the filter device and/or the turbulence device is provided. It is preferred that operation of the filter device takes place, at least at times, as a function of operation of the turbulence device, or that operation of the turbulence device takes place, at least at times, as a function of operation of the filter device. The operation of the turbulence device preferably includes, at least at times, providing the fluid and controlling the valve device. The valve devices are preferably controlled according to predetermined patterns, in particular at programmed time intervals. This approach is advantageous due to the fact that the impurities may be filtered out of the treatment substance very quickly and effectively.

The treatment objects together with the treatment substance preferably remain in the treatment container for longer than 5 minutes, in particular longer than 10 minutes, and preferably between 20 minutes and 120 minutes, in particular between 30 minutes and 90 minutes.

As a result of the method according to the invention, degreasing and/or descaling and/or preserving and/or decalcifying of the treatment object likewise take(s) place in addition to the pickling and phosphating, particularly preferably due to the fact that the treatment object is exposed to the treatment substance.

According to another preferred embodiment of the present invention, a pore-free protective layer is produced on the surface of the treatment object by means of the treatment substance, in particular by means of the reaction substance, with prevention of hydrogen embrittlement, wherein the protective layer has a thickness of at least 2 μm and preferably at least 3 μm. In particular, the pore-free protective layer protects the treatment object from oxygen and water, so that rust corrosion is effectively prevented.

The protective layer, in particular a phosphate layer, in particular an iron phosphate layer, preferably results from the treatment method according to the invention, in particular after a drying time of 3 hours to 48 hours, in particular 6 hours to 24 hours, in ambient air, or after a drying time of approximately 5 min to 60 min, in particular approximately 20 min, in an oven at 70° C. to 150° C., in particular at approximately or exactly 100° C., on the material surface of the treatment object (in particular made of stainless steel or standard steel). The resulting protective layer preferably has a thickness between 2 μm and 10 μm, in particular greater than or equal to 3 μm, 4 μm, or 5 μm. The protective layer preferably has a thickness of 2 μm to 10 μm, preferably 3 μm to 8 μm, and particularly preferably 4 μm to 6 μm. The protective layer preferably has no or essentially no pores, and is thus particularly preferably free of pores. In addition, the protective layer is elastic, and particularly preferably adapts to fluctuations of −60° C. to 750° C. and particularly preferably −40° C. to 680° C. without peeling off, wherein the protective layer preferably has a high bending capacity, in particular up to 180° or greater than 180° (for iron rods, for example). The protective layer may be an excellent base for further treatment, in particular color treatment, which, for example, may follow the method according to the invention. The protective layer preferably is neutrally reactive and does not form chemical compounds with hydraulic fluids. Further extremely important advantages of the method according to the invention are that, due to the protective layer, no rust corrosion of the treatment objects takes place, and during pickling a material removal of preferably less than 10 $g/m^2$, in particular less than 5 $g/m^2$, and particularly preferably 2.24 $g/m^2$ or less, takes place.

Furthermore, the treatment method according to the invention preferably also includes the step of controlling the temperature of the treatment substance that may be held in the treatment container, and/or the step of generating a flow of at least a portion of the treatment substance, wherein the treatment substance flows around at least a portion of the treatment object.

According to another preferred embodiment of the present invention, temperature control of the treatment substance that may be held in the treatment container takes place by means of a temperature control device, wherein by means of the temperature control device the temperature of the treatment substance is adjusted in a defined manner, and wherein a flow for moving at least a portion of the treatment substance [is generated] by means of a pump device, wherein the treatment substance flows around at least a portion of the treatment object.

According to another preferred embodiment of the present invention, the treatment substance is filtered by means of a filter device, wherein impurities that have become concentrated in the treatment substance are removed from the treatment substance by the filtering.

According to another preferred embodiment of the present invention, the treatment container is separated by a wall from a collection chamber for collecting treatment substance that flows over the wall, wherein the treatment substance collected in the collection chamber is conveyed via a conveyor line back into the treatment container by means of a conveying device, in particular by means of the pump device.

According to another preferred embodiment of the treatment method according to the invention, the pump device and the filter device form an integral part of the conveyor line, and the conveyed treatment substance is conveyed through the filter device by the pump device.

According to another preferred embodiment of the treatment method according to the invention, the conveyor line is designed in such a way that a weir flow for discharging a portion of the treatment substance from the treatment container and into the collection chamber is generated via the treatment substance that is conveyed back into the treatment container.

According to another preferred embodiment of the treatment method according to the invention, the composition of the treatment substance is controlled by means of a dosing device, wherein the treatment substance consists of a mixture of multiple components.

According to another preferred embodiment of the present invention, an additional substance for pickling degreasing and/or an additional substance for defoaming is admixed with the treatment substance, wherein the pickling degreaser additive preferably contains an aqueous solution of nonionogenic biodegradable surfactants and inhibitors, in particular 2-butyne-1,4-diol, and wherein the pickling degreaser additive is added in a volume of 0.5% to 7% of the volume of the phosphorus- or phosphate-containing solution or of the treatment substance, and wherein the defoamer additive preferably contains triisobutyl phosphate, and wherein the defoamer additive is added to the treatment substance in a volume of 0.1% to 1% of the volume of the phosphorus- or phosphate-containing solution or in a volume of 0.1% to 1% of the volume of the phosphorus- or phosphate-containing solution added to the pickling degreaser additive, or of the treatment substance.

According to another preferred embodiment of the present invention, the temperature control device is controlled by means of a control device in such a way that the treatment substance is controlled to a target temperature or a target temperature profile, and/or the pump device is controlled by means of the control device in such a way that the treatment substance is conveyed with a target flow velocity or a target flow characteristic, and/or the filter device is controlled by means of the control device in such a way that the filtered portion of the treatment substance has a target purity, and/or the dosing device is controlled by means of the control device in such a way that a target composition of the treatment substance is settable, and/or the turbulence device, in particular the provision device and/or the valve devices, in particular of the fluid line element and/or of the provision device, is/are controlled by means of the control device in such a way that turbulence or swirling up of the impurities, in particular solid particles such as metal particles, in particular rust particles, present, in particular deposited, in the treatment substance takes place.

The present invention is preferably likewise achieved by a treatment facility. The treatment facility according to the invention preferably includes at least one or more of the treatment devices mentioned and described above or below, in particular one or more treatment devices that is/are designed for producing a protective layer on the treatment object, wherein the protective layer preferably has a thickness of 1 μm to 10 μm and preferably 3 μm to 8 μm, or preferably 2 μm to 4 μm, and at least one further surface treatment device for treating the protective layer of the treatment object. The protective layer is preferably coated, in particular primed and/or galvanized, by the surface treatment device. The surface treatment device is therefore particularly preferably a flux bath for applying a primer to the surface of the treatment object, and a galvanizing device that is preferably designed for galvanizing the treatment object, at least in sections. In addition, a transport device for transporting the treatment object that is treated by means of the treatment device to the surface treatment device is provided.

The present invention further relates to a metallic object, in particular a metallic component such as a frame, in particular a vehicle frame, or a support element or connecting means or cladding element, or a metallic device such as a container. The metallic object preferably has at least one metallic portion, in particular a metallic surface portion. The metallic portion is preferably provided with a phosphorus- or phosphate-containing protective layer, wherein the protective layer has a thickness, for example, of 1 μm to 10 μm and preferably 3 μm to 8 μm, or preferably 2 μm to 4 μm. In terms of volume, the protective layer is particularly preferably completely, predominantly, or essentially pore-free. The protective layer is preferably coated, in particular primed and galvanized. The protective layer has preferably been produced by means of a treatment device mentioned and described above or below, or the protective layer has preferably been produced using a method mentioned and described above or below, or the protective layer and the coating provided on the protective layer have been produced by means of a treatment facility.

Use of the term "essentially," preferably in all cases in which this term is used within the scope of the present invention, defines a deviation in the range of 1%-30%, in particular 1%-20%, in particular 1%-10%, in particular 1%-5%, in particular 1%-2%, from the specification that would be provided without use of this term.

Single, or all, representations of the figures described below are preferably to be regarded as design drawings; i.e., the dimensions, proportions, functional relationships, and/or arrangements resulting from the figure(s) preferably correspond exactly or preferably essentially to those of the device according to the invention or the product according to the invention.

Further advantages, aims, and characteristics of the present invention are explained with reference to the following description of the appended drawings, in which treatment devices according to the invention are illustrated by way of example. Elements of the devices and methods according to the invention which in the figures match one another, at least essentially, with regard to their function may be denoted by the same reference numerals, wherein these components or elements need not be numbered or explained in all figures. The invention is described below, strictly by way of example, with reference to the appended figures.

BRIEF DESCRIPTION OF THE DRAWINGS

In the figures.

DETAILED DESCRIPTION

Figure 1:
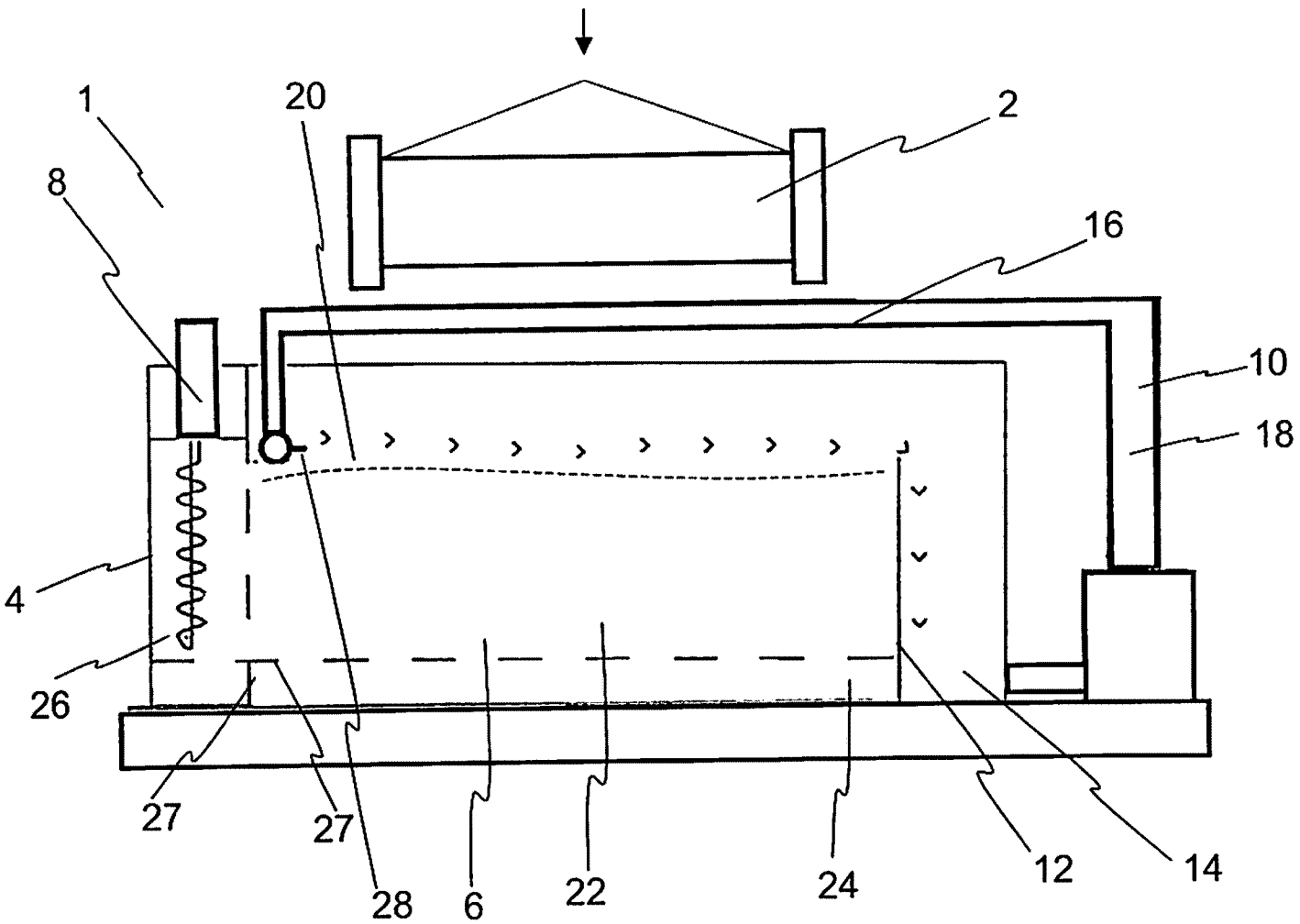
FIG. 1 shows a first illustration of a treatment device according to the invention in a passive state.

A treatment device 1 according to the invention is shown in FIG. 1. The treatment device 1 is used for treating, in particular for degreasing, pickling, phosphating, descaling, preserving, and derusting, one or more treatment objects 2. The treatment object 2 is preferably introduced from the top into a treatment container 4 of the treatment device 1. The treatment container 4 is preferably at least partially, and particularly preferably completely, filled with a treatment substance 6. In addition, a temperature control device 8 for controlling the temperature of, in particular for heating, the treatment substance 6 is preferably provided. Furthermore, preferably at least one pump device 10 for recirculating the treatment substance 6 and/or producing a weir flow 20 and/or conveying treatment substance 6 that has left the treatment container 4 back into the treatment container 4 is provided. The treatment container 6 is separated from a collection chamber 14 by a wall 12. Due to the flow produced in the treatment container 4, treatment liquid 6 exits the treatment container 4 over the wall 12 and thus passes into the collection chamber 14. However, it is also conceivable for the treatment substance or liquid 6, due to introducing the treatment object 2 into the treatment chamber 4, to undergo displacement in such a way that a portion of the treatment substance 6 passes from the treatment container 4 over the wall 12. Reference numeral 16 denotes a conveyor line by means of which the treatment substance 6 that has left the treatment container 4 is conveyed back into the treatment container 4. A filter device 18 for filtering or preparing the treatment substance 6 is preferably situated in the area of the conveyor line 16 or in the conveyor line 16 or as a part of the conveyor line 16. It is conceivable for the pump device 10 or another pump device (not shown) to be situated or provided in the route of the conveyor line 16. In addition, a pump filter device may be provided which either replaces a pump device and/or a filter device or which may be provided in addition to same. It is also apparent from the illustration that the treatment container 4 preferably has at least one main holding chamber 22, a first secondary holding chamber 24, and a second secondary holding chamber 26. The individual holding chambers 22, 24, 26 are separated from one another, for example, by grids 27, in particular a grating in each case. The grid 27 prevents the treatment object 2 from being able to pass into one of the secondary holding chambers 24, 26. Reference numeral 28 denotes a nozzle by means of which a flow of the treatment substance 6 may be produced.

Figure 2:
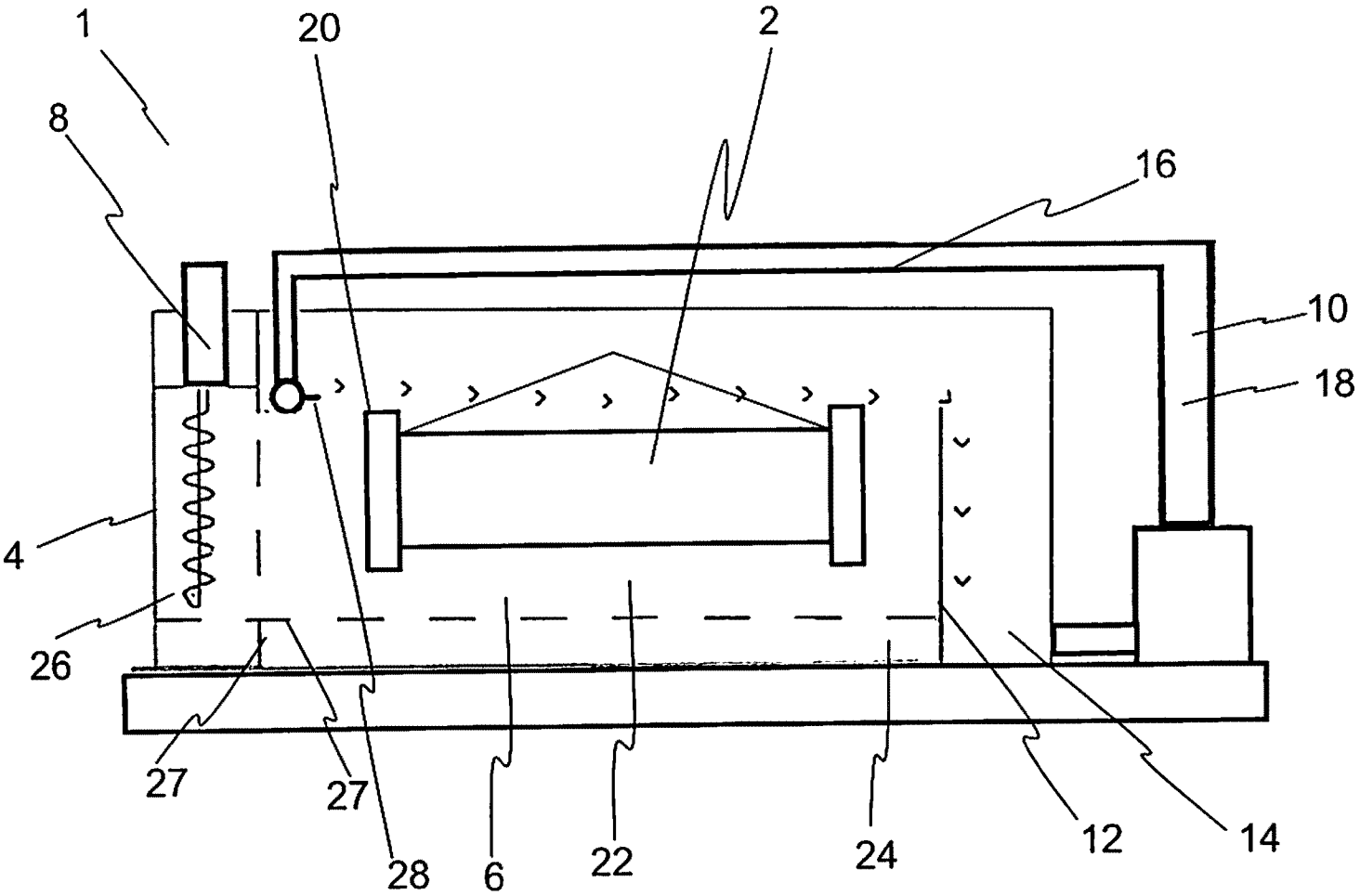
FIG. 2 shows a second illustration of a treatment device according to the invention in an active state.

FIG. 2 shows the illustration known from FIG. 1, wherein the treatment object 2 according to this illustration is situated in the treatment container 4 and is thus in contact with the treatment substance 6.

Figure 3:
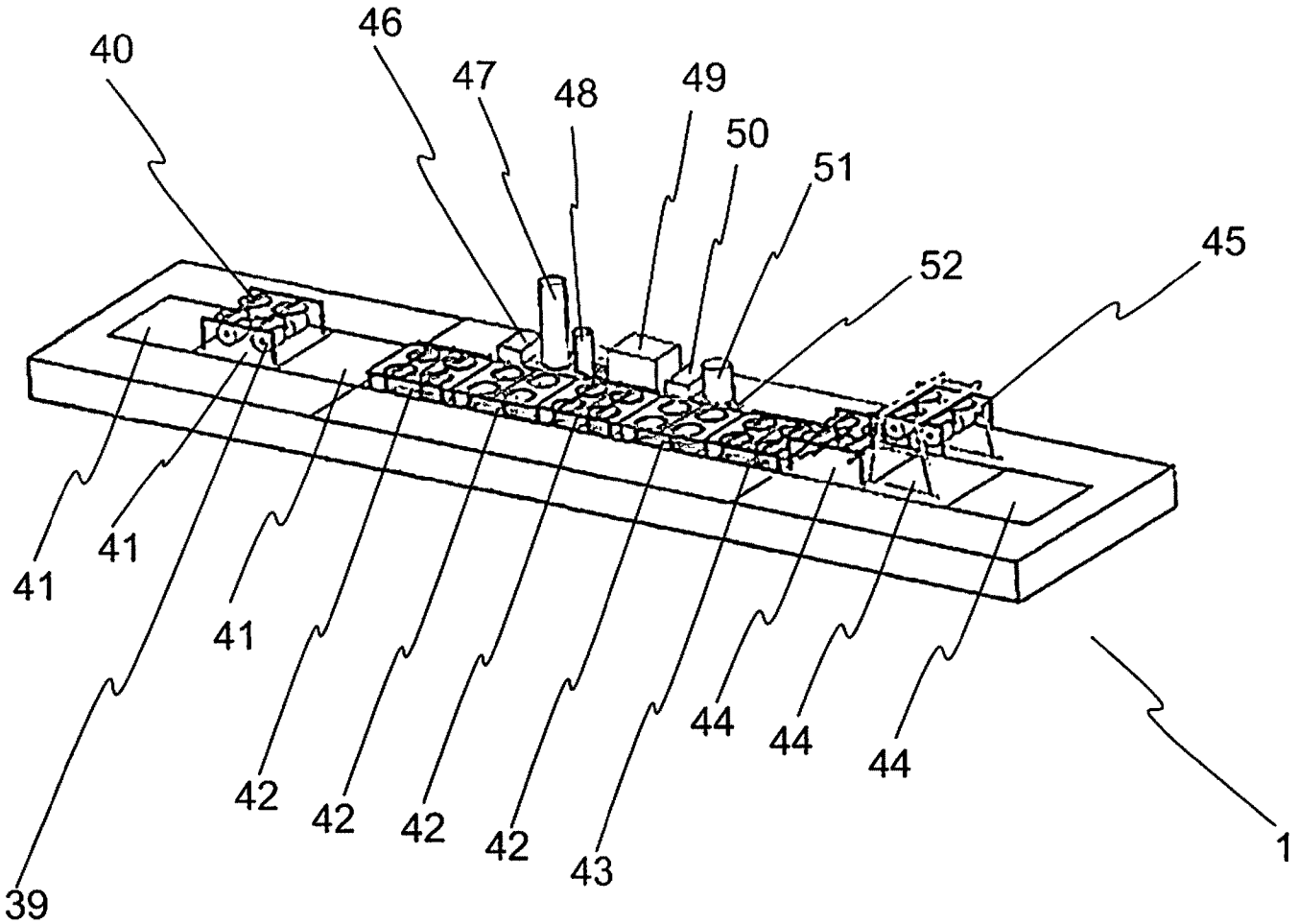
FIG. 3 shows a perspective illustration of a further treatment device according to the invention.

FIG. 3 shows another embodiment variant of a treatment device 1 according to the invention, in particular for wire coil treatment. The treatment device 1 shown in FIG. 3 has, by way of example, a holding rack 40 which preferably bears multiple wire coils 39 to be treated. The holding rack 40 is situated on a delivery point 41, preferably multiple holding racks 40 and multiple delivery points 41 being provided. In addition, the treatment device 1 preferably has multiple, in particular 2, 3, 4, 5, 6, 7, 8, or more, treatment baths 42. A plurality, in particular 2, 3, 4, 5, 6, 7, 8, 9, or more, of wire coils 39 are preferably introducible, in particular simultaneously, into a treatment bath 42 for the treatment. Reference numeral 43 denotes a preferably strictly optional device, namely, a fixing bath. It is conceivable for multiple wire coils 39, in particular 2, 3, 4, 5, 6, 7, 8, or more, to be simultaneously introducible into a fixing bath 43. Furthermore, it is conceivable for multiple fixing baths 43 to be provided. The treated wire coils 39 may be situated at a removal point 44 for removal. The treated wire coils 39 are preferably conveyed to the particular removal point 44 by a transport device 45, in particular a transport car or a rail-guided gantry crane. In addition, preferably multiple devices for supplying, regulating, and controlling the treatment device 1 are provided. Thus, the illustrated embodiment includes, for example, a pressure belt filter device 46, a dosing device 47, a deionized water treatment unit 48, a control device 49, a further pressure belt filter device 50, a storage tank for a treatment basin 51, and multiple side channel compressors 52, in particular eight units. The dosing device 47 is preferably automated, and particularly preferably has a buffer tank with a volume of preferably greater than 5 $m^3$, particularly preferably greater than 10 $m^3$, and most preferably greater than or equal to 20 $m^3$.

Figure 4:
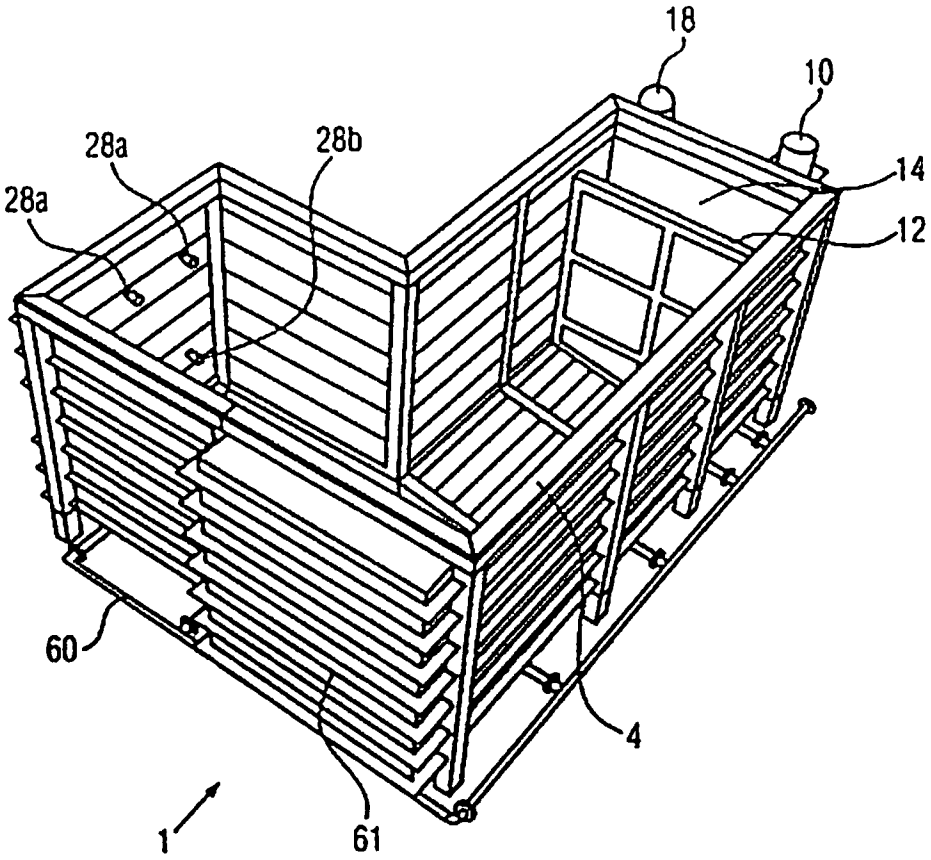
FIG. 4 shows a perspective illustration of yet a further treatment device according to the invention.

FIG. 4 shows a perspective illustration of a treatment device 1 according to the invention. The treatment device 1 is preferably L-shaped; i.e., it comprises a treatment container 4, the treatment container 4 having an interior portion that extends preferably at right angles to a second interior portion. One interior portion is preferably longer than the other interior portion, it also being conceivable for the interior portions to have the same length or essentially the same length. The illustrated design allows, for example, curved elements such as pipes, supports, claddings, etc., to be treated. The treatment container 4 preferably has at least or exactly one wall 12, wherein an area into which the treatment objects to be treated are introduced is separated from a collection chamber 14 by the wall 12. The collection chamber 14 is preferably used for collecting treatment substance that exits the treatment chamber over the wall 12.

Reference numeral 10 denotes a pump device, in particular for generating a flow within the treatment substance that is to be introduced into the treatment chamber. Reference numeral 18 denotes a filter device 18 for filtering or preparing the treatment substance.

A movement or flow of the treatment substance is brought about by means of nozzles 28*a*, 28*b* and 29*a*, 29*b*, 29*c* (see FIG. 5), from which the treatment substance that is conveyed by means of the pump device 10 is pumped into the treatment chamber.

The enclosure 61 encloses or houses the nozzles 29*a*-29*c*. Three rows with two nozzles 28*a*, 28*b* and three rows with three nozzles 29*a*, 29*b*, 29*c* are preferably provided, it also being conceivable for exactly or at least one nozzle 28 and/or 29 to be provided. The nozzles 28 are particularly preferably oriented at an angle with respect to the nozzles 29, in particular at right angles.

Figure 7:
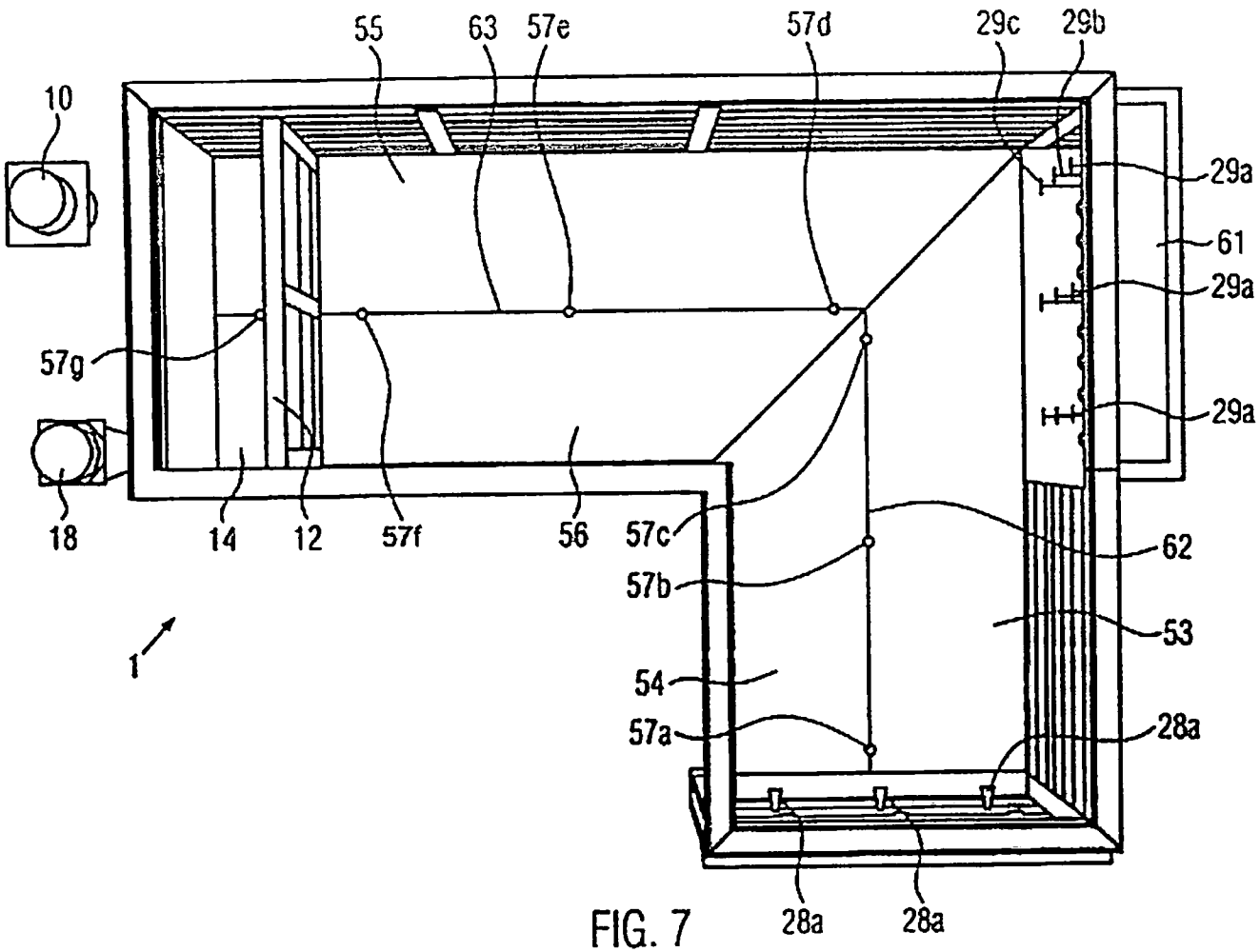
FIG. 7 shows a first top view of the treatment device according to the invention shown in FIGS. 4 through 6.

Reference numeral 60 denotes a main suction line by means of which treatment substance is discharged, in particular suctioned, from the treatment chamber via outlets 57*a*-57*g* (see FIG. 7). The discharged treatment substance is preferably prepared by means of the filter device 18 and conveyed back into the treatment chamber through the nozzles 28 and 29 by means of the pump device 10.

The treatment device 1 may preferably be dimensioned in such a way that an installation area of 5100 mm×3800 mm is required. The treatment device 1 preferably encompasses a bath volume of essentially up to, at least, or exactly 14 $m^3$. The useful volume of the treatment device 1 according to the invention is preferably 3400 mm×3000 mm×1500 mm, and the height of the overflow at the top edge is preferably 200 mm.

Figure 5:
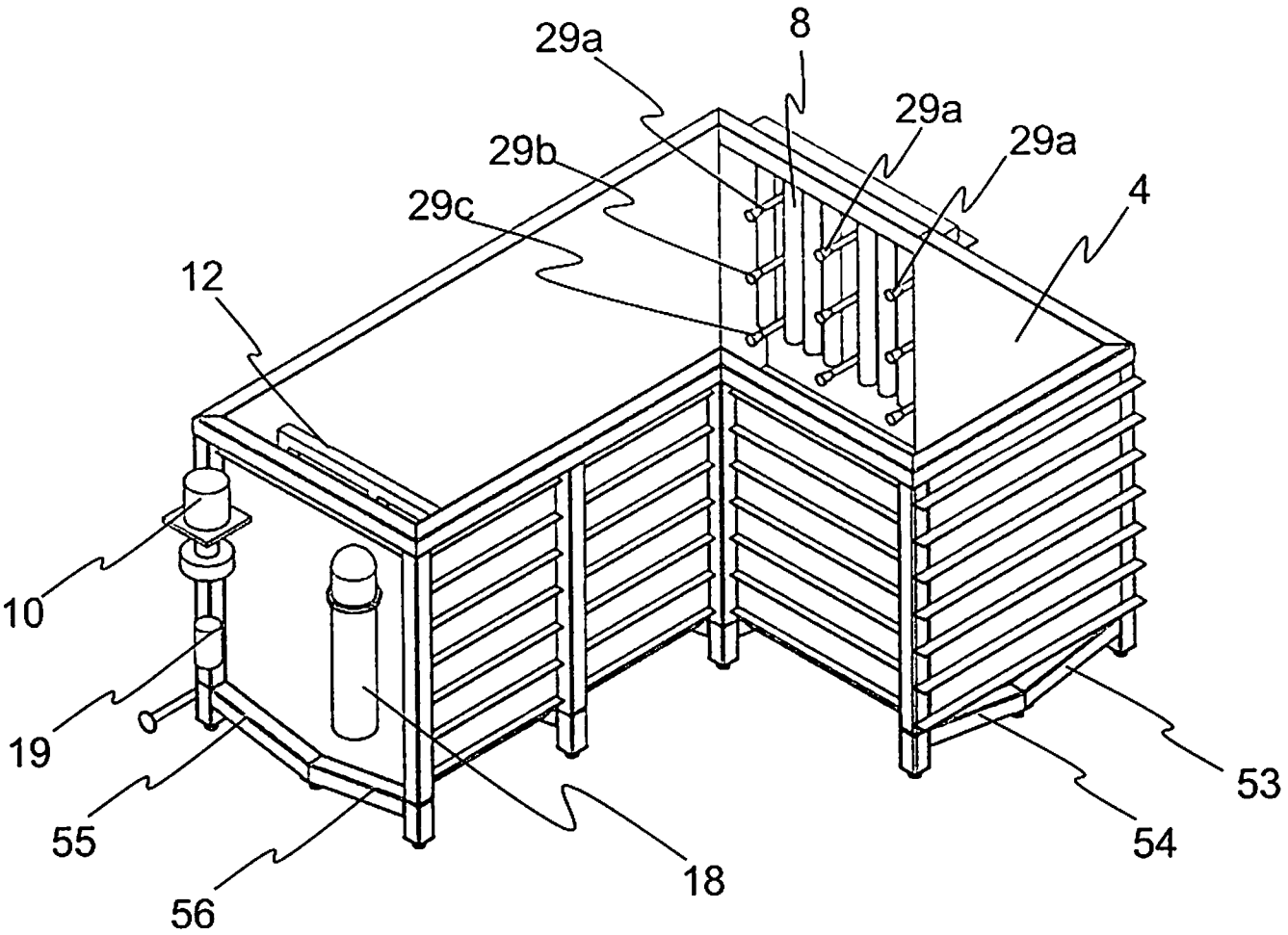
FIG. 5 shows another perspective illustration of the treatment device according to the invention shown in FIG. 4.

FIG. 5 shows another view of the above-mentioned embodiment of the treatment device 1 according to the invention. It is apparent from this illustration that the nozzles 29*a*-29*c* or the 3×3 nozzle arrangement are/is preferably accommodated in a pocket 61 in a wall of the treatment container 4, in order to preferably not interfere with or impair the useful area. The nozzles 28*a*-28*b* are likewise preferably accommodated in a pocket in another wall of the treatment container 4, in order to preferably not interfere with or impair the useful area. The pockets 61 are preferably provided with impact protection, not illustrated, to avoid damage to the fixtures.

In addition, a further filter device 19 is illustrated, the further filter device 19 preferably being designed as a coarse filter. It is particularly preferred that the treatment substance to be prepared is initially suctioned from the treatment container, then supplied to the further filter device 19, then conducted by the pump 10, then led through the filter device 18, which preferably may be designed as a bag filter, and then conveyed back into the treatment container via the nozzles 28, 29.

In addition, the illustration shows that the base of the treatment container 4 has surface portions 53, 54, 55, 56 that are inclined with respect to the horizontal. The surface portions 53-54 and 55-56 are in each case preferably situated in such a way that, in the area of a low point viewed with respect to a vertical direction, they form a linear contact area with one another. The contact area is preferably situated at a level below a contact area between the outer wall of the container extending in the vertical direction and the respective surface portion or base portion 53, 54. The surface portions or base portions 53, 54 and 55, 56 thus preferably form channels through which the treatment substance and dirt particles are conducted in a targeted manner to one or more outlets. The surface portions 53-56 are preferably oriented with respect to the horizontal with an inclination of 2° to 25°, particularly preferably with an inclination of 6° to 15°, and most preferably with an inclination of essentially or exactly 10°.

Reference numeral 8 denotes a temperature control device that is preferably provided. The temperature control device 8 preferably has eight electric heating elements, in particular of 2 kW each. The heating elements are preferably likewise accommodated in the pocket 61 in the wall, in order not to interfere with or impair the preferably required useful area. The design of the heat output of the temperature control device may preferably be based on a Wessling unit (20 $m^3$=20 kW heat output).

Figure 6:
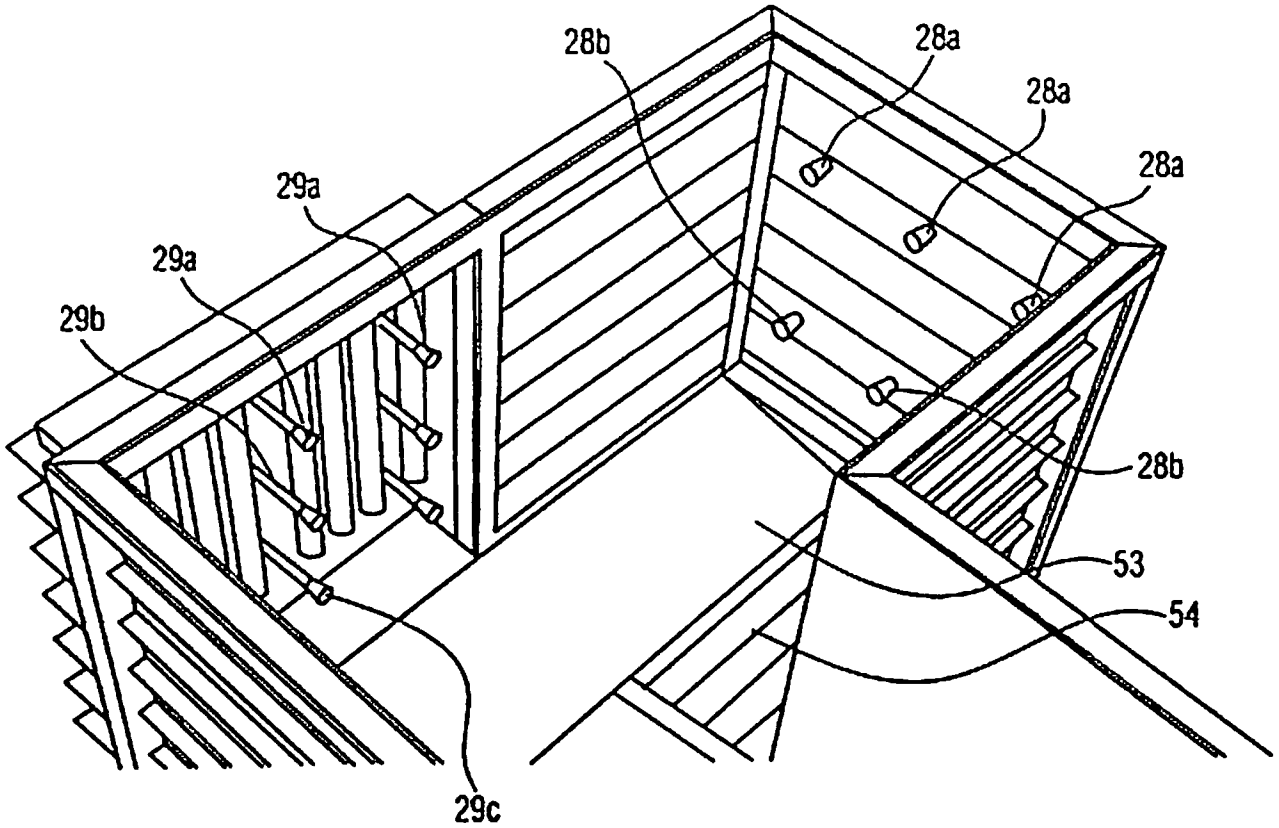
FIG. 6 shows a perspective detail illustration of a portion of the treatment device according to the invention shown in FIGS. 4 and 5.

FIG. 6 shows in particular a detail illustration of the pocket 61 in which the nozzles 29*a*-29*c* and the temperature control device 8 are preferably situated.

FIG. 7 shows the first portion of a channel 62 resulting from the mutually inclined base portions 53, 54 and 55, 56 of the treatment container 4, and the resulting second portion 63 of the channel. The channel preferably also extends into the collection chamber 14. Outlets 57*a*-57*f*, in particular multiple outlets, for discharging or for suctioning out the treatment substance from the treatment chamber are particularly preferably provided in the channel or in the area of the channel. In addition, at least one outlet 57*g* for discharging or for suctioning out the treatment substance from the collection chamber 14 is preferably provided in the collection chamber 14. The outlets 57*a*-57*g* are preferably fluidically connected to the main suction line 61 via connecting lines.

Not illustrated is a grating which is preferably horizontally oriented, or which, oriented at right angles to the side walls of the treatment container 4, overlaps the base 53, 54, 55, 56 of the treatment chamber, wherein the grating is spaced apart from the base, in particular at a distance greater than 20 mm, preferably greater than 50 mm, and particularly preferably greater than 100 mm, wherein the grating is particularly preferably situated at a maximum distance of 500 mm from the base of the treatment container. The grating preferably takes on the function of spacing a treatment object that is introduced into the treatment chamber at a distance from the base of the treatment chamber, as the result of which particles that are detached from the treated treatment objects may accumulate beneath the treatment object, so that suction extraction of these particles is always possible.

Figure 8:
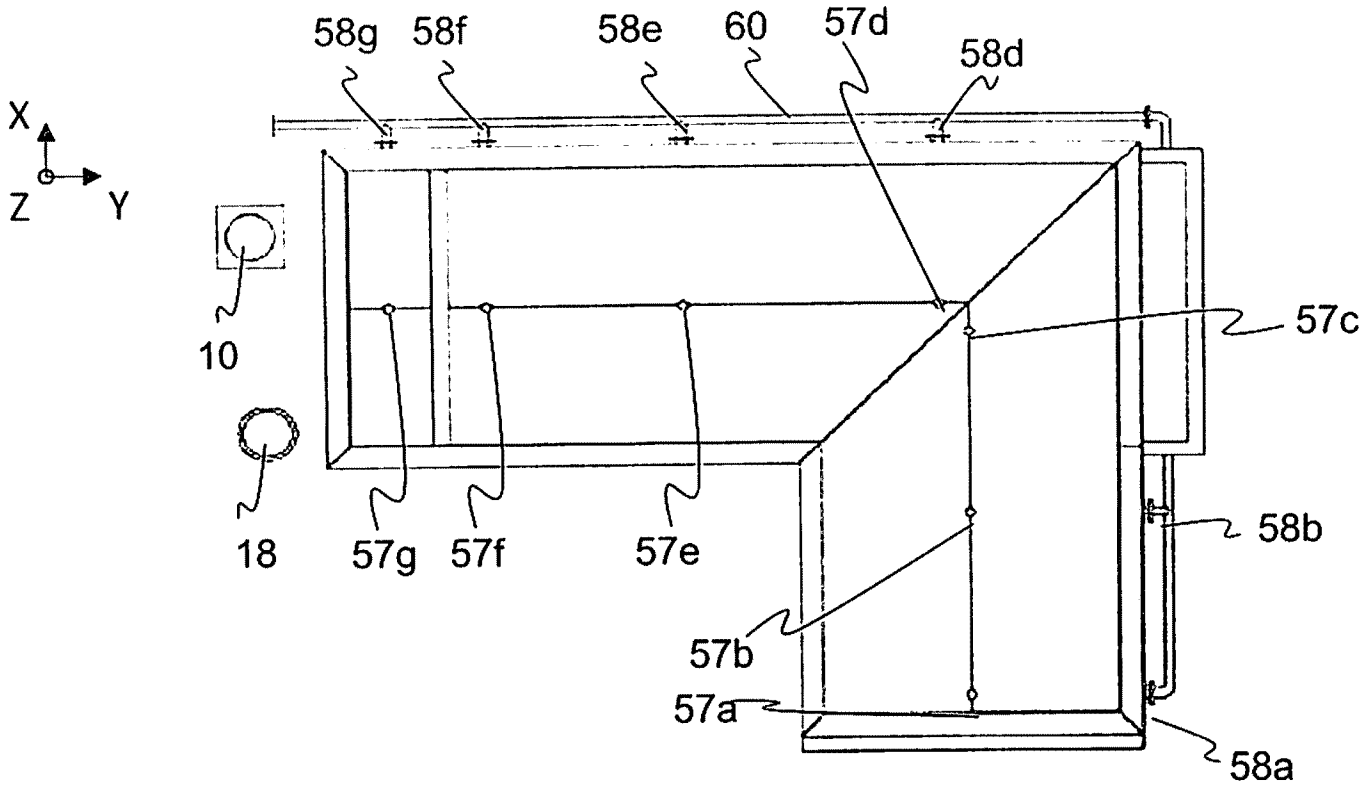
FIG. 8 shows a second top view of the treatment device according to the invention shown in FIGS. 4 through 6.

FIG. 8 shows the main suction line 60 and a portion of the connecting tubes 58*a*-58*g* via which the outlets 57*a*-57*g* are connected to the main suction line 60. The overall suction line, which is preferably made up at least of the connecting tubes 58*a*-58*g* and the main line 60, preferably has a dismountable design. This is advantageous in particular for cleaning the individual parts of the overall suction line.

Figure 9:
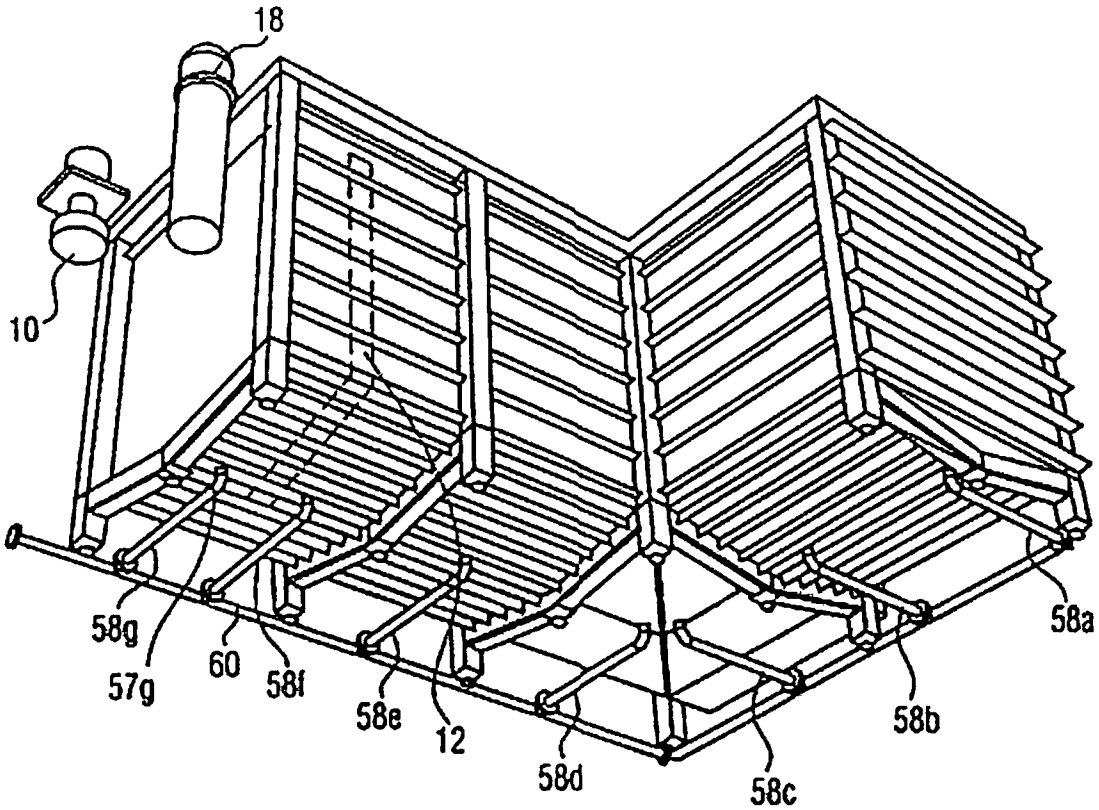
FIG. 9 shows a perspective illustration of essentially the bottom side of the treatment device according to the invention shown in FIGS. 4 through 8.

FIG. 9 shows a perspective illustration of the bottom side of the treatment device 1 according to the invention. In particular the connecting tubes 58*a*-58*g* that are connected to the outlets and to the main suction line are apparent in this illustration.

Figure 10A:
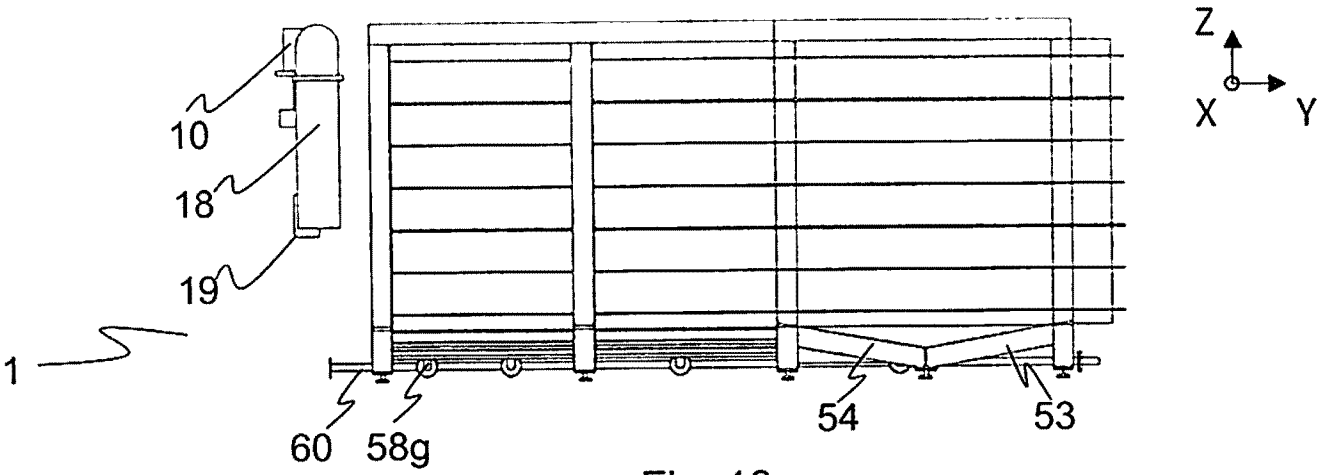
FIG. 10*a* shows a first schematic side view of the treatment device according to the invention shown in FIGS. 4 through 9.
Figure 10B:
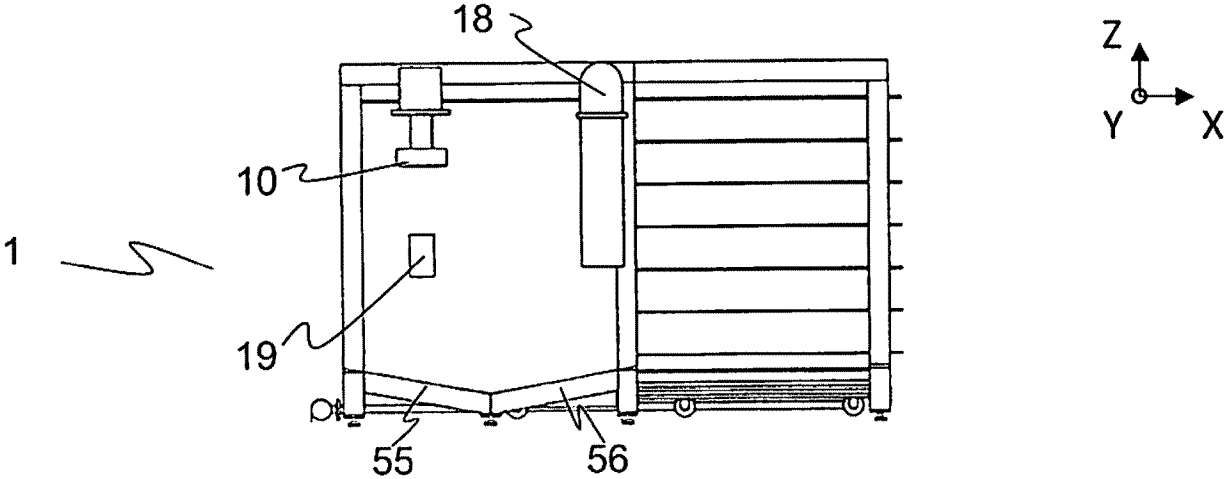
FIG. 10*b* shows a second schematic side view of the treatment device according to the invention shown in FIGS. 4 through 9.

FIGS. 10*a* and 10*b* show different side views of the treatment device 1 according to the invention shown in FIGS. 4 through 9.

Figure 11:
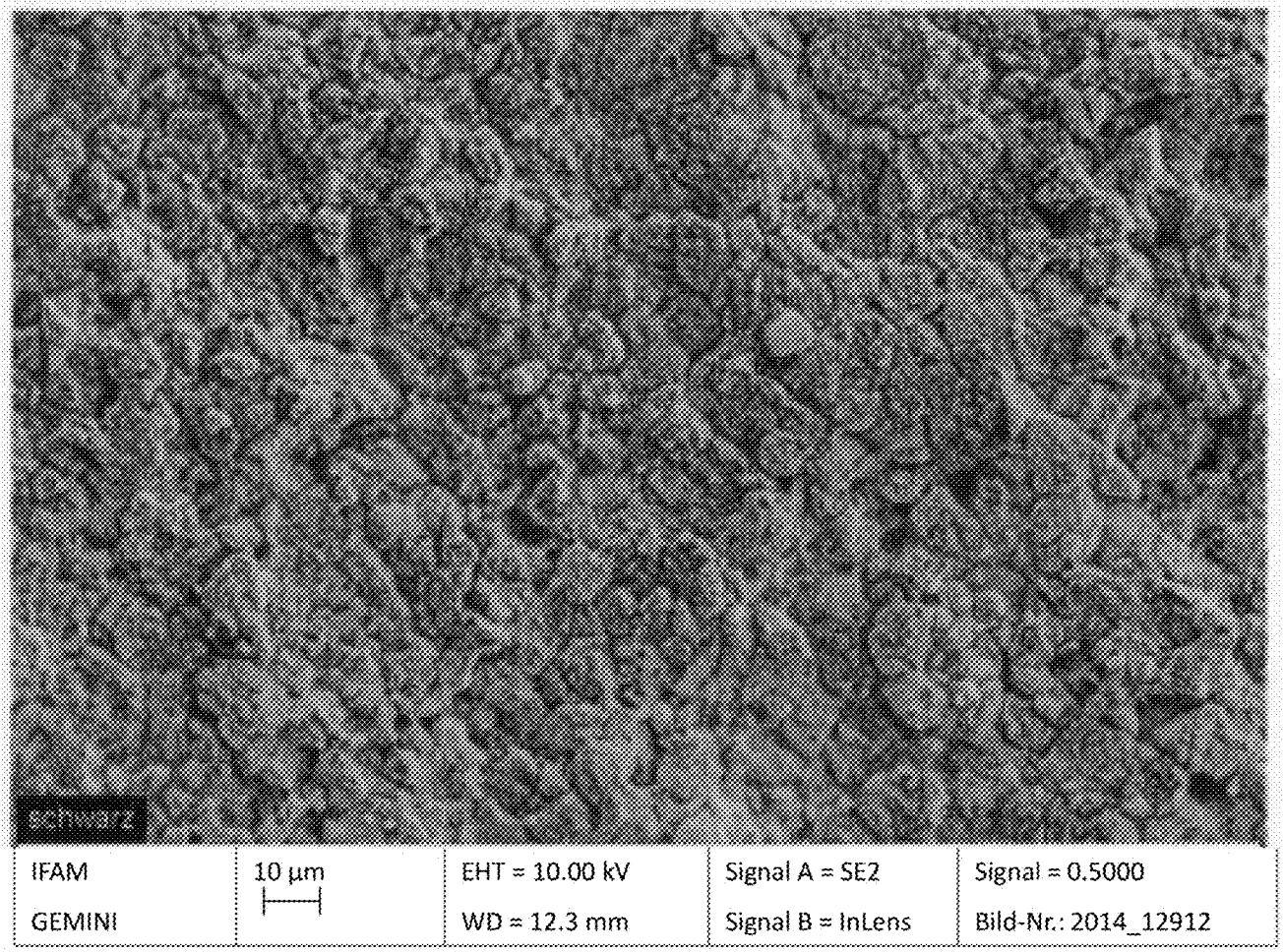
FIG. 11 shows a scanning electron micrograph of a steel sheet that has been treated by the method according to the invention.
Figure 12:
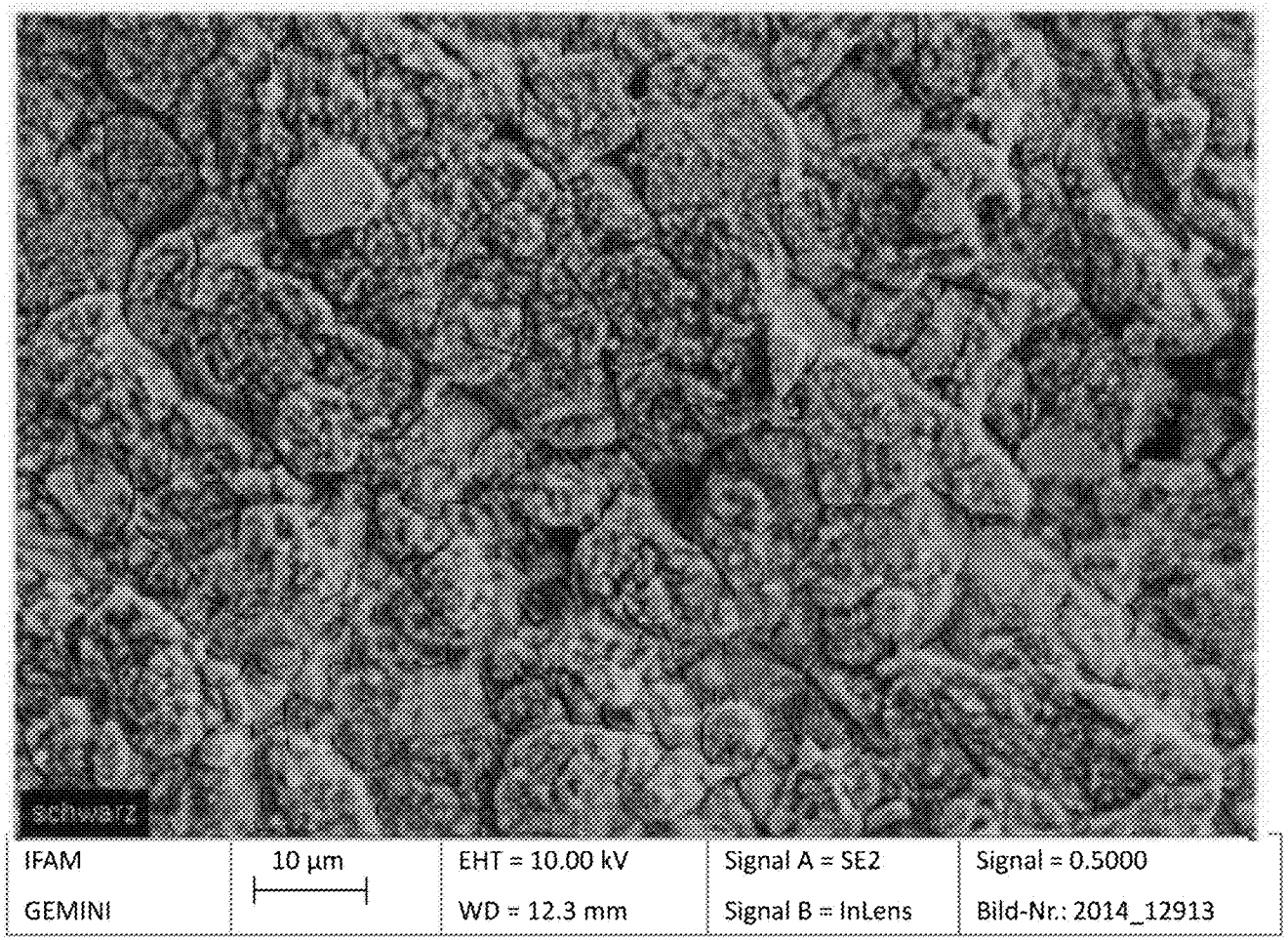
FIG. 12 shows an enlarged illustration of the scanning electron micrograph from FIG. 11.

FIGS. 11 and 12 each show a steel sheet that has been treated using the method according to the invention, resulting in a closed surface structure made up of the phosphorus deposited on the steel sheet. The scanning electron micrographs were created by Fraunhofer Institute based on the specifications stated in the figures:

IFAM
GEMINI
Resolution 10 μm
EHT=10.00 kV
WD=12.3 mm
Signal A=SE2
Signal B=InLens
Signal=0.5000

It is seen from the resolution below 10 μm that, although the structure in the micrograph has a somewhat relief-like photographic design, due to the high magnification it is apparent to one skilled in the art that a smooth, closed surface structure has resulted from the phosphorus deposited on the steel sheet.

Figure 13:
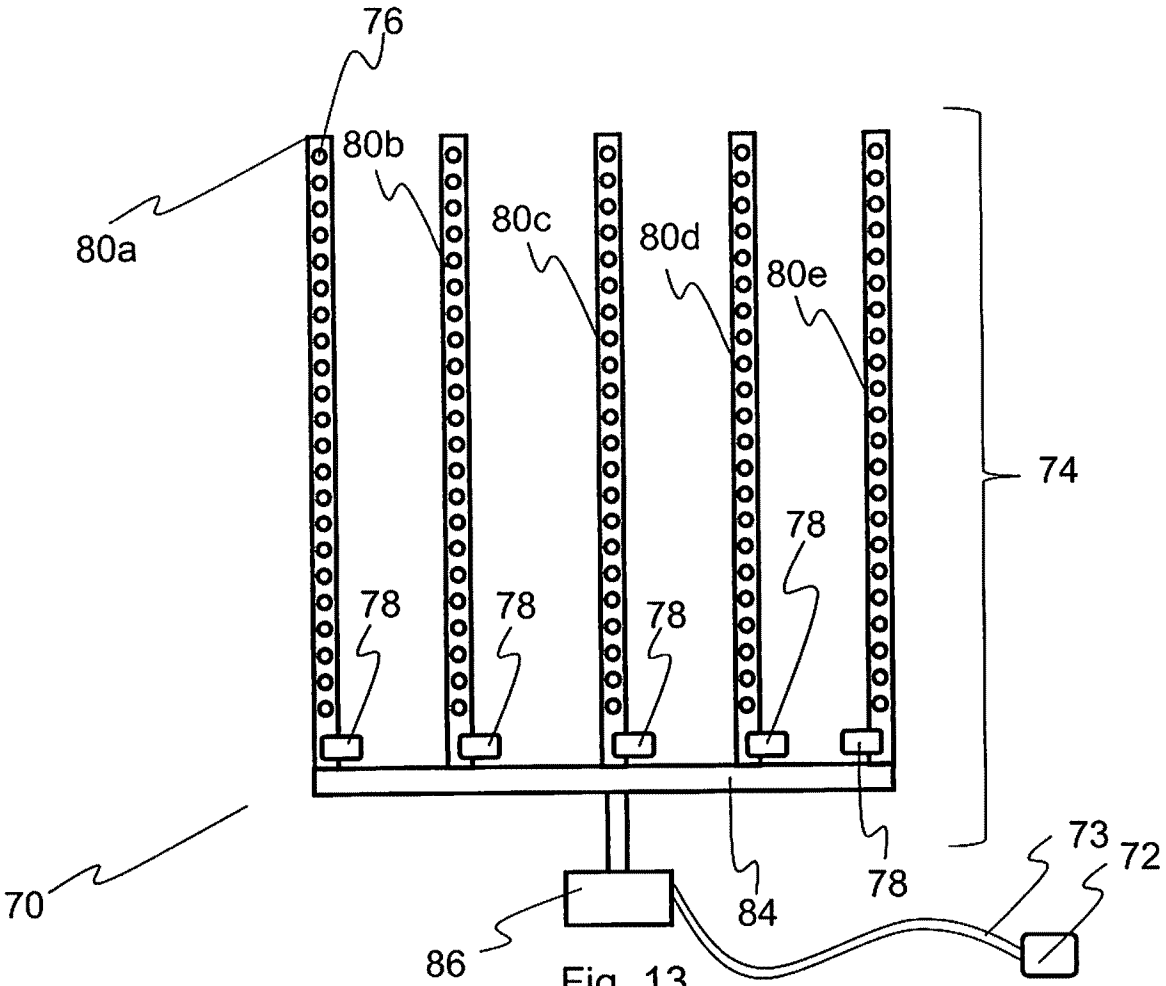
FIG. 13 shows an example of a turbulence device as preferably provided according to the present invention, preferably in a treatment container according to one of FIGS. 1 through 10.

FIG. 13 shows a schematic illustration of an example of a turbulence device 70 in a top view. The turbulence device 70 may be designed as a fixed integral part of a treatment container 4, or may be detachably connected to such a treatment container 4. The turbulence device 70 preferably includes a fluid line element 74 that is preferably formed from one or more line sections 80*a*-80*e*. The individual line sections 80*a*-80*e* may be formed by lines, in particular hoses or tubes. Each line section 80*a*-80*e* preferably has a plurality of outlet openings 76 through which a turbulizing fluid, which is suppliable to the fluid line element 74 via a fluid provision device 72, may exit or escape from the fluid line element 74. The individual line sections (preferably tubes) are particularly preferably connected or coupled to a distributor device 84. Each line section 80*a*-80*e* is preferably connected or coupled to a valve device 78, in particular a solenoid shutoff valve. The valve devices 78 are in each case preferably situated between the distributor device 84 and the first outlet device 76, in the fluid flow direction of the turbulizing fluid that is conducted through the fluid line element. In addition, it is conceivable for multiple line sections 80*a*-80*e* to be coupled to a shared valve device 78, or in the case of one or more line sections, for a shared valve device 78, in particular a shutoff valve, for example a solenoid shutoff valve, to be provided. A control device 86 and/or pulse generating device 86 are/is preferably connected to the distributor device 84. The control device 86 preferably brings about the opening and/or closing of one, individual, multiple, the majority of, or all valve devices 78, in particular shutoff valves 78. The control device 86 preferably has a control device valve apparatus via which a fluid communication channel, by means of which the turbulizing fluid is supplied to the control device 86, may be interrupted, limited, or opened. The fluid communication channel is preferably formed on the one hand by the distributor unit 84 together with the line sections 80*a*-80*e* connected thereto, and on the other hand by a line connection 73, in particular a hose, that is in communication connection with a fluid provision device 72. Alternatively, however, the fluid provision device 72 may also be connected directly to the control device 86 and/or to the distributor unit 84. The fluid provision device 72 is preferably a pressurized fluid connection of a pressurized fluid source, for example a pressurized gas connection of a pressurized gas source, in particular a compressed air connection of a compressed air source. This may be, for example, a compressor and/or a pressurized storage device.

Figure 14:
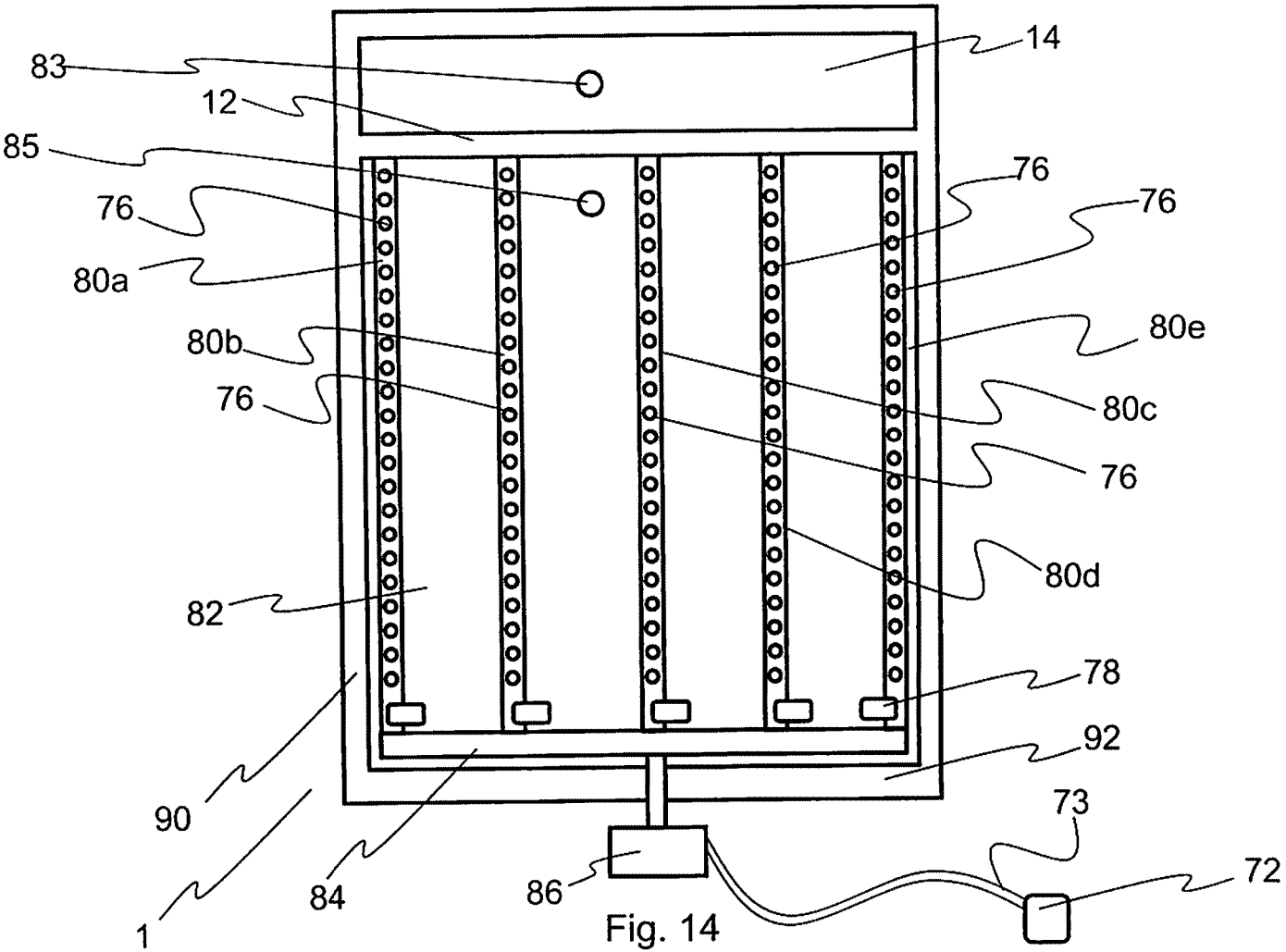
FIG. 14 shows the turbulence device known from FIG. 13 strictly by way of example, situated in a treatment container strictly by way of example.

In FIG. 14, the turbulence device 70 known from FIG. 13 and described strictly by way of example is situated in a treatment container 4, and thus forms, as an example, the device according to the invention. In the longitudinal direction, the treatment container 4 is delimited on the one hand by the weir wall 12 and on the other hand by the rear wall 92. In the width direction. the treatment container is delimited on the one hand by the first side wall 90 and on the other hand by the second side wall 91. The base 82 of the treatment container 4 preferably has a discharge opening 85 through which the treatment substance is dischargeable, in particular conductible or pumpable, from the main holding chamber. The discharge opening 85 is preferably connected to the filter device 18 in such a way that the treatment substance that is discharged via the discharge opening 85 is supplied or suppliable to the filter device. The weir wall 12 on the other hand delimits the collection chamber 14, into which the impurities, turbulized by the turbulence device 70, together with the treatment substance flowing over the weir wall 12, may be conducted via the discharge opening 83 to the filter device 18 for filtering. Tubes, in particular made of stainless steel, having a preferred diameter between 4 mm and 6 mm are thus preferably fixedly installed on the wall base of the treatment facility. These tubes are preferably combined via a distributor unit. Each tube is particularly preferably provided with a shutoff valve, it being alternatively conceivable for only the distributor unit to be provided with a valve device, in particular a shutoff valve such as a solenoid shutoff valve, so that individual partial areas or the entire area in the bath may be acted on in a targeted manner. That is, the turbulizing fluid may be supplied to one or more tubes as needed in a targeted manner, as the result of which specific flows or turbulences may be generated in the treatment substance. The pressurized turbulizing fluid, in particular compressed air, is admitted into the bath or the treatment substance via the fluid line element or the tubing, preferably during the downtime of the treatment facility or the device according to the invention, and the contaminants still resting on the base are thus swirled up so that they may be distributed in the liquid or the treatment substance. The admission, in particular the blowing in, of the turbulizing fluid, in particular the compressed air, is preferably controlled via a timing valve and/or a control device 86, and may take place in a uniform or pulsing manner, continuously or at programmed time intervals, or as a function of detected sensor measuring data. The filter device 18 or the installed filter unit preferably runs at the same time while the fluid is blown in, and particularly preferably runs up to 3 hours afterwards or up to 2 hours afterwards or up to 1 hour afterwards or for more than 3 hours afterwards, and removes the turbulized contaminants from the treatment substance.

Figure 15:
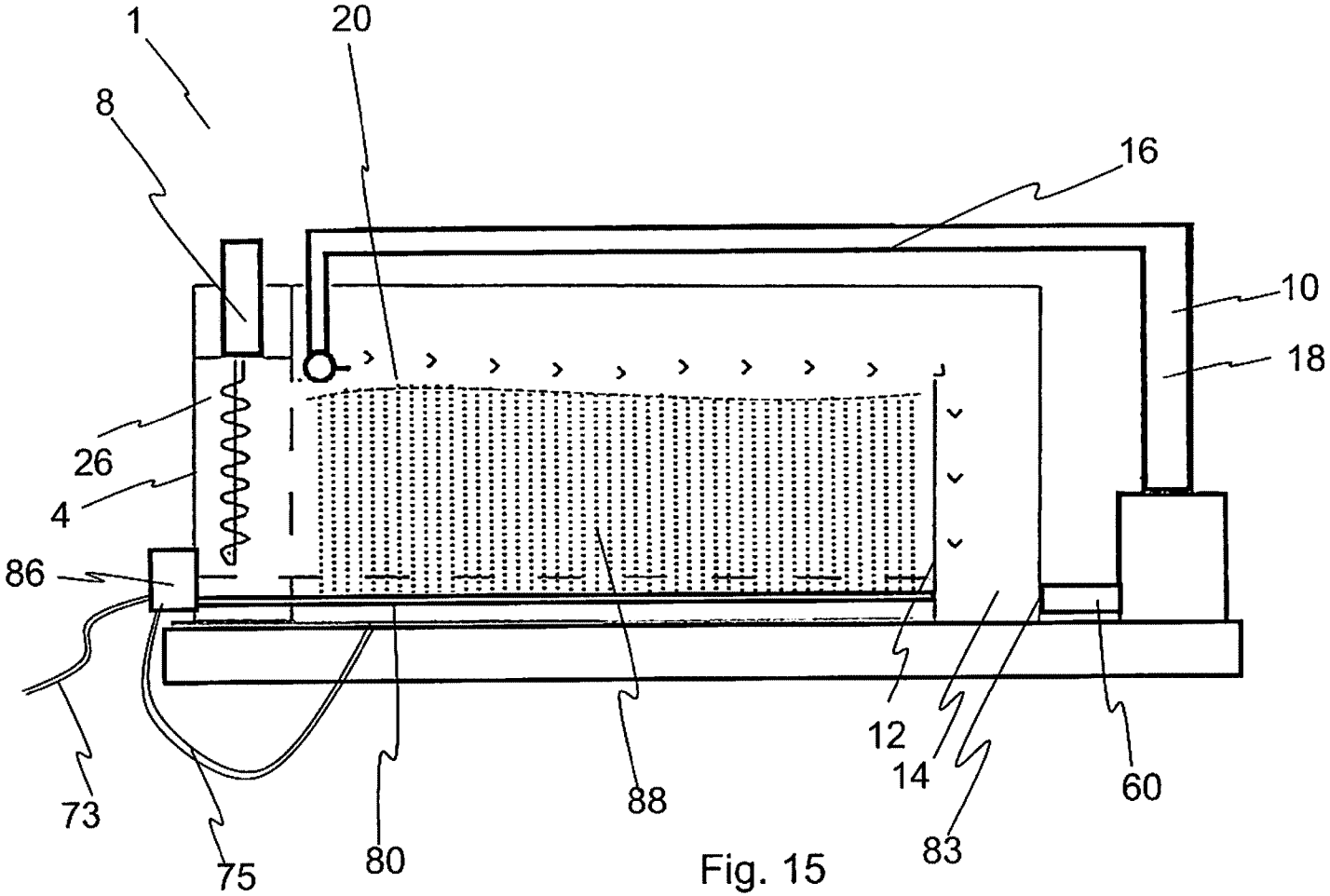
FIG. 15 shows a side view of a device according to the invention with a turbulence device preferably situated therein.

FIG. 15 schematically shows the rising turbulizing fluid, in particular the rising air bubbles 88. The treatment substance is turbulized by the air bubbles 88 that exit through the outlet openings 76. In addition, the air bubbles cause impurities, in particular sludge, to be stirred up from the base area of the device according to the invention and conveyed upwardly to the weir flow. FIG. 15 also shows a line 75 strictly as an alternative to the line 73. The line 75 may be coupled to the treatment container 4 in such a way that portions of the treatment substance may be removed from the treatment container 4. The portions of treatment substance removed by means of the line 75 are then supplied to the turbulence device 70, preferably by means of a pump device (not shown). The turbulizing fluid for turbulizing the treatment substance provided in the treatment container and delivered by the turbulence device 70, in this case to the treatment substance provided in the treatment container, is thus the portion of the treatment substance that is discharged via the line 75. The line 75 may be connected, for example, to the treatment substance removal means or to the opening or mouth or suction opening 85.

Figure 16:
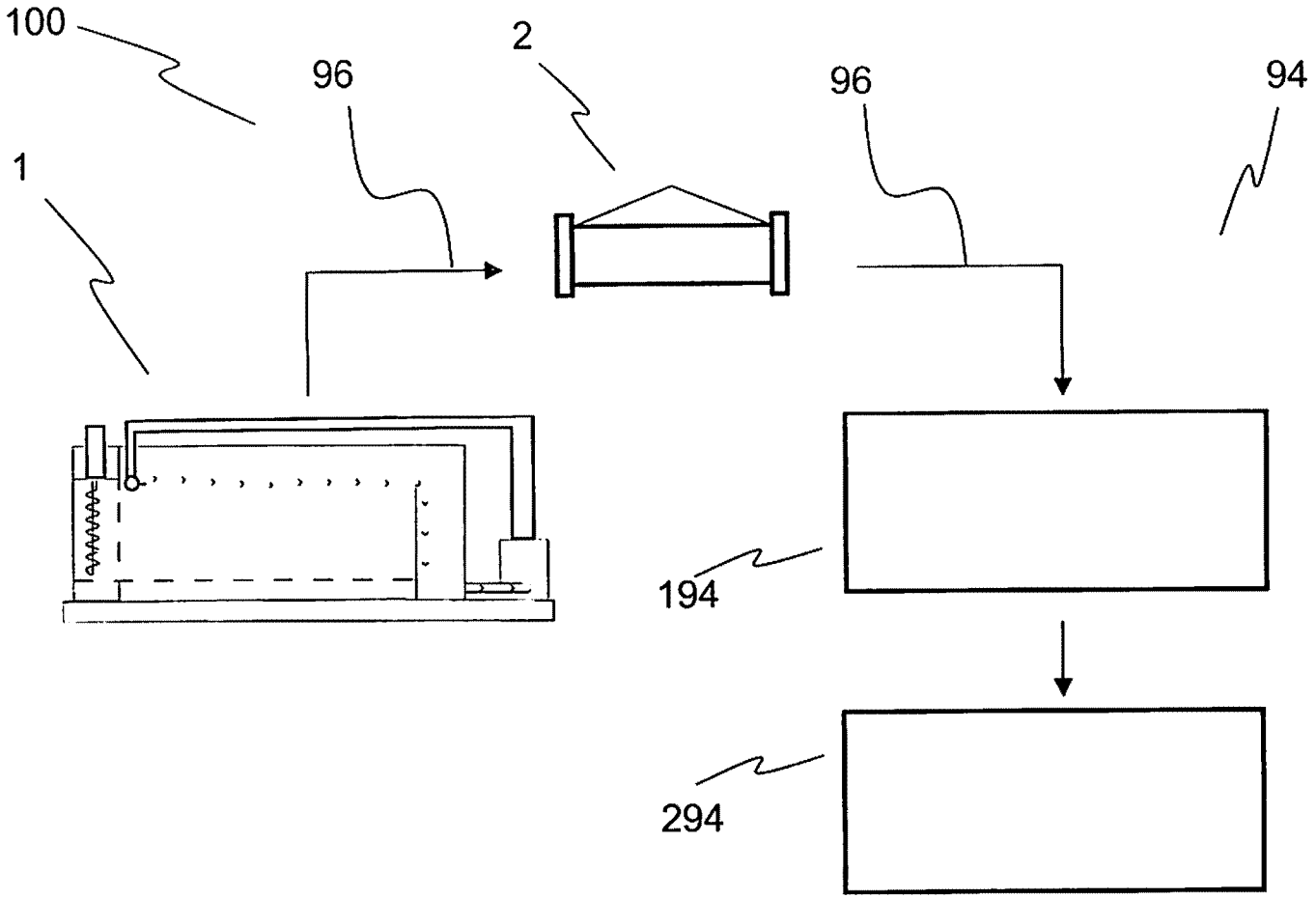
FIG. 16 shows a treatment facility with at least one treatment device, a flux device, and a galvanizing device.

FIG. 16 shows a schematic design of the treatment facility 100 according to the invention, strictly by way of example. According to this illustration, one or more of the treatment devices 1, as known from the preceding figures, for example, may be provided. In addition, one or more surface treatment devices 94 may [be provided] for further surface treatment of the treatment object 2, previously treated by means of the treatment device 1. Further treatment preferably takes place for at least a portion of the surface of the treatment object 2, particularly preferably for at least the majority of the surface of the treatment object 2, and most preferably for essentially or exactly the entire surface of the treatment object 2. The surface treatment device 94 is preferably designed for coating the treatment object 2. One or more material layers are preferably applied or produced on the surface of the treatment object 2 by the surface treatment device 94. Priming and/or galvanizing of the treatment object 2 is preferably brought about by the surface treatment device 94.

In addition, it is conceivable for a drying device (not shown) for drying the treatment object 2 to be provided or situated in the transport path 96, between the treatment device 1 and the surface treatment device 94. Additionally or alternatively, it is conceivable for a drying device (not shown) to be provided or situated downstream from the surface treatment device 94 or as an integral part of the surface treatment device.

The surface treatment device 94 preferably has at least one flux device 194, in particular a flux bath, for fluxing the treatment object, and a galvanizing device 294. The flux device 194 preferably has a holding container, in particular a vat, which is at least partially filled with a fluxing agent or a fluxing active substance, in particular a chloride such as ammonium chloride or zinc chloride, or a mixture of flux active substances. Alternatively, it is conceivable for the treatment object to be wetted with the flux active substance or the flux active substances, in particular acted on by a mist or a liquid jet. As a result of the flux device, a type of adhesion promoter or primer is produced on the protective layer produced by the treatment device, or the protective layer is converted into an adhesion-promoting layer by the fluxing. After the fluxing, the treatment object 2 is preferably dried, in particular in a drying device not shown. The drying device may be an integral part of the flux device 194 or the galvanizing device 294, as an alternative it also being conceivable for the drying device to be a device that is separate, in particular structurally, functionally, spatially, and/or energetically separate, from the flux device 194 and/or the galvanizing device. The drying device is preferably situated in the transport path of a transport device, between the flux device 194 and the galvanizing device 294. The drying in the drying device preferably takes place at a temperature between 70° C. and 150° C., in particular at a temperature between 80° C. and 120° C.

The galvanizing device 294 is preferably designed for batch galvanizing or strip galvanizing. The galvanizing device 294 preferably includes a hot zinc bath. The temperature of the zinc bath is preferably 450° C. or essentially 450° C.

The treatment object 2 is thus initially supplied to the treatment device 1 and modified therein by the treatment substance, in particular cleaned, pickled, and provided with a phosphorus or phosphate layer.

Figure 17B:
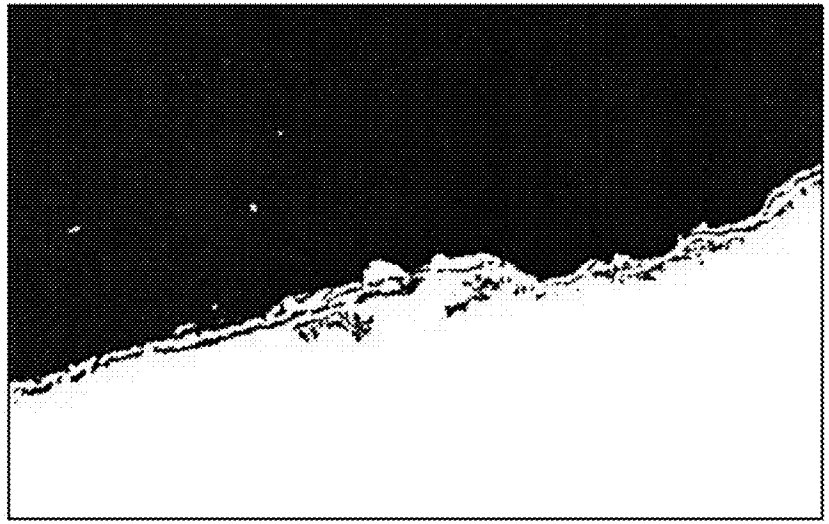
FIG. 17*b* shows a scanning electron micrograph of the phosphating produced by means of the treatment device 1.
Figure 17A:
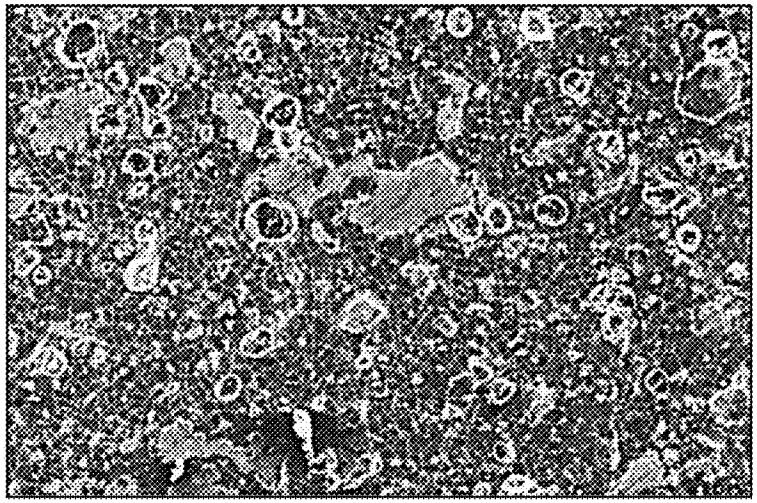
FIG. 17*a* shows a scanning electron micrograph of a surface phosphated by means of the treatment device.

FIG. 17*a* shows a scanning electron micrograph of a surface phosphated by means of the treatment device. It is apparent that the phosphate layer is heterogeneous. The layer thickness is only a few microns, in particular less than or equal to 100 microns or less than or equal to 80 microns or less than or equal to 70 microns or less than or equal to 65 microns or less than or equal to 63 microns or less than or equal to 60 microns or less than or equal to 58 microns or less than or equal to 55 microns or less than or equal to 50 microns.

FIG. 17*b* shows a scanning electron micrograph of the phosphating produced by means of the treatment device 1.

Figure 18A:
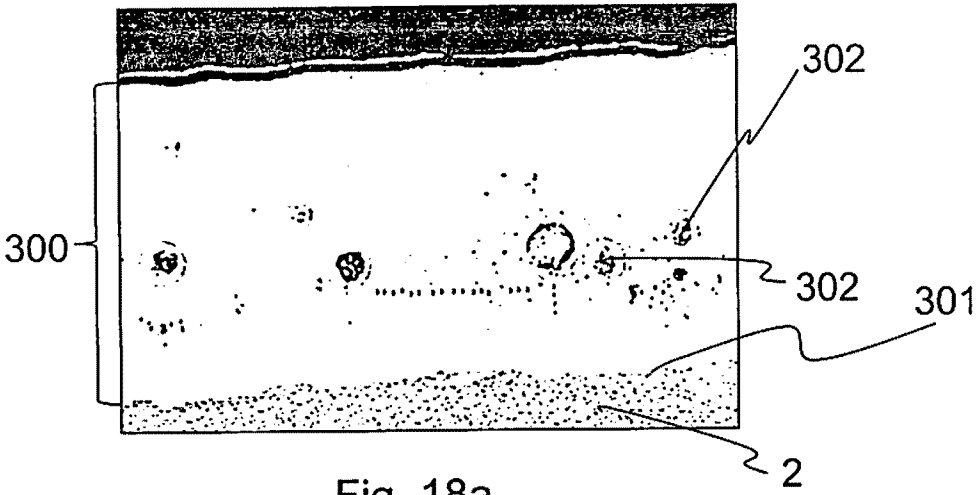
FIGS. 18*a/b* each show an illustration of a zinc layer produced on a metallic object by means of the treatment facility according to the invention.
Figure 18B:
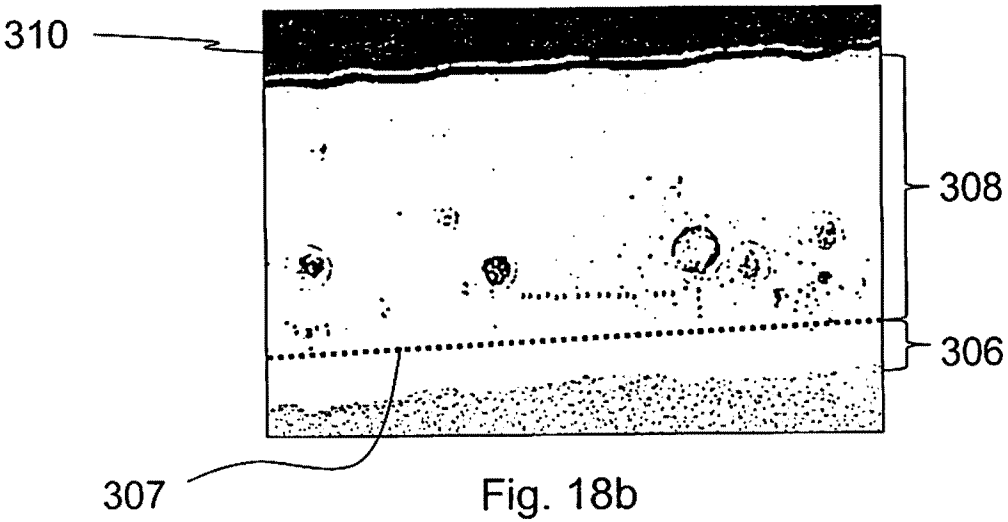

FIGS. 18*a* and 18*b* show a cross section of a portion of a metallic object 2 and a zinc layer that is formed on the metallic object 2 or as an integral part of the metallic object 2. The metallic object is in particular a metallic component such as a frame, in particular a vehicle frame, or a support element or connecting means or cladding element, or a metallic device such as a container, or the treatment object as previously described with reference to the other figures. The metallic object 2 includes at least one metallic portion, wherein a zinc layer 300 is formed on at least one surface 301 of the metallic portion, wherein preferably bubble-shaped inclusions 302 are present in the zinc layer 300, wherein the bubble-shaped inclusions 302 particularly preferably contain phosphorus or a phosphate. In addition, the zinc layer 300 in a first section 306 directly adjoining the metallic portion is preferably present in a Zn/X phase, where X stands for a material, in particular iron (Fe), that is an integral part of the metallic portion. Thus, if the metallic object is a body made at least partially, preferably predominantly, and particularly preferably completely, of iron, an iron compound, an iron alloy, or a steel, a Zn/Fe phase is thus preferably present in the first section. The first section 306 is preferably adjoined by a second section 308 that is formed by a zinc phase, wherein the bubble-shaped inclusions 302 are preferably situated at least predominantly, particularly preferably completely, in the second section 308. The second section 308 is preferably higher or thicker than the first section 306. The second section 308 is thus preferably at least as high or thick as the first section 306. The height or thickness of the second section 308 is particularly preferably 1.5 times, in particular more than 2 times or more than 2.5 times or more than 3 times, as great as for the first section 306.

Reference numeral 310 denotes embedding material which is used solely for recording the illustration shown.

The above-described layer formation is producible on a treatment object by treating the treatment object 2 using the treatment facility 100 according to the invention, in particular by treating using the treatment device 1 according to the invention, followed by fluxing in a flux device, in particular a flux bath, and subsequent galvanizing, in particular hot dip galvanizing.

The present invention preferably relates to a treatment device 1 for the single-stage treatment of a metal treatment object 2, wherein the treatment comprises at least the pickling and the phosphating of the treatment object 2, wherein the treatment device 1 includes at least the following stated devices: a treatment container 4 for holding the treatment object 2 and for holding a flowable treatment substance 6, a pump device 10 for recirculating at least a portion of the treatment substance 6, wherein the treatment substance 6 flows around at least a portion of the treatment object 2, in particular the entire treatment object 2, wherein the treatment substance 6 is a phosphorus- or phosphate-containing solution, in particular phosphoric acid, wherein the phosphorus- or phosphate-containing solution consists of water on the one hand and a reaction substance on the other hand, and a turbulence device 70 for turbulizing impurities, in particular solid particles, that deposit in the treatment substance, wherein the turbulence device 70 has at least one provision device 72 and a fluid line element 74 with a plurality of outlet openings 76 for supplying a turbulizing fluid to the treatment substance 6, wherein the turbulizing fluid is suppliable by the provision device 72 to the fluid line element 74 at a pressure of greater than 2 bar.

The present invention particularly preferably relates to a treatment device 1 for the single-stage treatment of a metallic treatment object 2, wherein the treatment comprises at least the pickling and the phosphating of the treatment object 2. The treatment device 1 according to the invention preferably includes at least the following stated devices: a treatment container 4 for holding the treatment object 2 and for holding a flowable treatment substance 6, a pump device 10 for recirculating at least a portion of the treatment substance 6, wherein the treatment substance 6 flows around at least a portion of the treatment object 2, in particular the entire treatment object 2, wherein the treatment substance 6 is a phosphorus- or phosphate-containing solution, in particular phosphoric acid, wherein the phosphorus- or phosphate-containing solution consists of water, in particular deionized water, on the one hand and a reaction substance on the other hand. The reaction substance preferably consists of phosphorus or a phosphate and at least one additional substance that improves the treatment effect, in particular containing one or more inhibitors. The proportion of phosphorus or phosphate in the reaction substance is preferably between 75 vol % and 94 vol %, preferably between 80 vol % and 90 vol %, particularly preferably between 83 vol % and 88 vol %. The reaction substance preferably contains no fractions of hydrochloric acid or sulfuric acid, and preferably also contains no fractions of fluorine, chlorine, bromine, iodine, lead, mercury, or selenium, and is mixed with water preferably in a ratio of between 1 kg reaction substance to 4 liters water and 1 kg reaction substance to 12 liters water, in particular in a ratio of 1 kg reaction substance to 6 liters [water].

The invention may preferably relate to a treatment method for preparing a treatment object 2 that is in particular metallic. The method preferably comprises at least the following steps: providing a treatment container 4 for holding at least one treatment object 2 and for holding a flowable treatment substance 6, introducing the treatment substance 6 into the treatment container 4, wherein no further treatment container for pickling and phosphating is used, introducing the treatment substance 6 into the treatment container 5, and introducing the treatment object 2 into the treatment container 4 that is at least partially filled with the treatment substance 6 in order to bring the treatment object 2 into contact with the treatment substance 6, wherein at least cleaning, in particular degreasing, and phosphating of the treatment object 2 is brought about due to the contact between the treatment substance 6 and the treatment object 2, wherein the treatment substance 6 is a phosphorus- or phosphate-containing solution, in particular phosphoric acid, wherein the phosphorus- or phosphate-containing solution consists of water on the one hand and a reaction substance on the other hand, wherein the reaction substance consists of phosphorus or a phosphate and an additional substance that improves the treatment effect, wherein the proportion of phosphorus or phosphate in the reaction substance is less than 95%, wherein the reaction substance contains no fractions of hydrochloric acid or sulfuric acid, wherein after removal from the treatment container, the treatment object is supplied to a first surface treatment device and subsequently to a second surface treatment device, wherein the protective layer is provided with an adhesion-promoting layer or is converted into an adhesion-promoting layer by the first surface treatment device, and galvanizing of the treatment object is brought about by the second surface treatment device.

| List of reference numerals | |
|---|---|
| 1 | treatment device |
| 2 | treatment object |
| 4 | treatment container |
| 6 | treatment substance |
| 8 | temperature control device |
| 10 | pump device |
| 12 | wall |
| 14 | collection chamber |
| 16 | conveyor line |
| 18 | filter device |
| 19 | further filter device |
| 20 | weir flow |
| 22 | main holding chamber |
| 24 | first secondary holding chamber |
| 26 | second secondary holding chamber |
| 27 | grid |
| 28 | nozzle |
| 39 | wire coil |
| 40 | treatment device for treating wire |
| 41 | delivery point |
| 42 | treatment bath |
| 43 | fixing bath |
| 44 | removal point |
| 45 | transport device |
| 46 | pressure belt filter device |
| 47 | dosing device |
| 48 | deionized water treatment unit |
| 49 | control device |
| 50 | further pressure belt filter device |
| 51 | storage tank |
| 52 | side channel compressor |
| 53 | first inclined base portion |
| 54 | second inclined base portion |
| 55 | third inclined base portion |
| 56 | fourth inclined base portion |

-continued

| List of reference numerals | |
|---|---|
| 57 | outlet |
| 58 | connecting tube |
| 60 | main suction line |
| 61 | pocket with nozzles |
| 62 | first portion of the channel |
| 63 | second portion of the channel |
| 70 | turbulence device |
| 72 | provision device |
| 73 | line |
| 74 | fluid line element |
| 76 | outlet openings |
| 78 | valve device |
| 80 | line sections/tubes |
| 80a | first line section |
| 80b | second line section |
| 80c | third line section |
| 80d | fourth line section |
| 80e | fifth line section |
| 82 | base |
| 84 | distributor unit |
| 86 | control unit |
| 84 | discharge opening in the collection chamber |
| 86 | discharge opening in the main holding chamber |
| 88 | rising fluid (preferably air) |
| 90 | side wall |
| 92 | rear wall |
| 94 | surface treatment device |
| 96 | transport path |
| 100 | treatment facility |
| 194 | flux device |
| 294 | galvanizing device |
| 300 | zinc layer |
| 301 | surface of the metallic object |
| 302 | inclusions |
| 306 | Zn/X phase |
| 307 | boundary area |
| 308 | Zn phase |
| 310 | embedding material |

The invention claimed is:

1. A treatment device for treating a metallic treatment object, wherein the treatment comprises at least pickling and phosphating of the treatment object, wherein the treatment device comprises:

a treatment container for holding the treatment object and for holding a flowable treatment substance;

a pump device for recirculating at least a portion of the treatment substance;

a filter device; and a turbulence device for turbulizing impurities that deposit in the treatment substance;

wherein the treatment substance may flow around at least a portion of the treatment object, wherein the treatment substance is a phosphorus- or phosphate-containing solution, wherein the turbulence device has at least one provision device and a fluid line element with a plurality of outlet openings for supplying a turbulizing fluid to the treatment substance, wherein the turbulizing fluid is suppliable by the provision device to the fluid line element at a pressure of greater than 2 bar, wherein the fluid line element forms multiple line sections that are decoupleable from one another by means of valve devices, at least the majority of the line sections being situated in an area of a base of the treatment container, wherein the treatment container is separated by a wall from a collection chamber for collecting treatment substance that flows over the wall, wherein the treatment substance collected in the collection chamber is conveyable back into the treatment container by means of a conveyor line, wherein the pump device and the filter device form an integral part of the conveyor line, and the conveyed treatment substance is conveyed through the filter device by the pump device, and wherein the conveyor line is designed in such a way that a weir flow for discharging a portion of the treatment substance from the treatment container and into the collection chamber is producible via the treatment substance that is conveyed back into the treatment container.

2. The treatment device according to claim 1 wherein the filter device is configured to remove from the treatment substance impurities that have become concentrated in the treatment substance, and a control device for operating the filter device and/or the turbulence device is provided, wherein the filter device and the turbulence device are operable, at least at times, in dependence on one another.

3. The treatment device according to claim 1 wherein the turbulence device is operable to provide the fluid and control the valve devices, at least at times, wherein the valve devices are controllable according to predetermined patterns.

4. The treatment device according to claim 1 wherein the treatment container has a main holding chamber into which the treatment object is introducible, and a first secondary holding chamber, wherein the main holding chamber and the first secondary holding chamber are connected to one another in such a way that the treatment substance on the one hand may flow out of the main holding chamber into the first secondary holding chamber, and on the other hand may flow from the first secondary holding chamber into the main holding chamber, wherein the main holding chamber and the first secondary holding chamber are delimited from one another in such a way that penetration of the treatment object into the first secondary holding chamber is at least partially prevented, and wherein the main holding chamber is likewise coupled to a second secondary holding chamber, wherein the first secondary holding chamber is a buffer holding chamber, provided beneath the main holding chamber, for holding a certain quantity of treatment substance, and wherein the second secondary holding chamber is a temperature control chamber, wherein the temperature control device is at least partially situated in the second secondary holding chamber.

5. The treatment device according to claim 1 wherein the line sections are formed by tubes, wherein the tubes are coupled to the base of the treatment container or situated thereon, wherein the tubes are connected to one another by means of at least one distributor unit, and wherein each valve device is designed as a shutoff valve, and the provision device is designed to provide gas that is under at least 2 bar pressure.

6. The treatment device according to claim 5 wherein the tubes each have a diameter between 2 mm and 12 mm.

7. The treatment device according to claim 5 wherein the tubes each have a diameter between 3 mm and 9 mm.

8. The treatment device according to claim 5 wherein the tubes each have a diameter between 4 mm and 6 mm.

9. The treatment device according to claim 1 wherein the treatment substance comprises a defoamer additive for defoaming, and wherein the defoamer additive is added to the treatment substance in a volume of 0.01% to 5% of the volume of the phosphorus- or phosphate-containing solution, or is added in a volume of 0.01% to 5% of the volume of the phosphorus- or phosphate-containing solution added to a pickling degreaser additive, and/or a pickling degreaser additive for pickling degreasing is added to the treatment substance, wherein the pickling degreaser additive is added in a volume of 0.5% to 7% of the volume of the phosphorus- or phosphate-containing solution.

10. The treatment device according to claim 9 wherein the defoamer additive comprises triisobutyl phosphate.

11. The treatment device according to claim 9 wherein the pickling degreaser additive comprises an aqueous solution of nonionogenic biodegradable surfactants and inhibitors.

12. The treatment device according to claim 9 wherein the pickling degreaser additive comprises 2-butyne-1,4-diol.

13. The treatment device according to claim 9 wherein the pickling degreaser additive is added to the treatment substance in a volume of 1% to 5% of the volume of the phosphorus- or phosphate-containing solution.

* * * * *